US012571131B2

(12) United States Patent
Hedlund et al.

(10) Patent No.: US 12,571,131 B2
(45) Date of Patent: Mar. 10, 2026

(54) PROCESSING FOR SPINNING ALKALINE CELLULOSE SPIN DOPE

(71) Applicant: TREETOTEXTILE AB, Stockholm (SE)

(72) Inventors: Artur Hedlund, Gothenburg (SE); Bengt Hagström, Gothenburg (SE)

(73) Assignee: TREETOTEXTILE AB, Stockholm (SE)

( * ) Notice: Subject to any disclaimer, the term of this patent is extended or adjusted under 35 U.S.C. 154(b) by 43 days.

(21) Appl. No.: 18/575,919

(22) PCT Filed: Jul. 4, 2022

(86) PCT No.: PCT/EP2022/068459

§ 371 (c)(1),
(2) Date: Jan. 2, 2024

(87) PCT Pub. No.: WO2023/280779

PCT Pub. Date: Jan. 12, 2023

(65) Prior Publication Data

US 2024/0309558 A1 Sep. 19, 2024

(30) Foreign Application Priority Data

Jul. 5, 2021 (EP) ..... 21183794
Dec. 3, 2021 (EP) ..... 21212307

(51) Int. Cl.
*D01D 5/06* (2006.01)
*D01D 4/02* (2006.01)
(Continued)

(52) U.S. Cl.
CPC ..... *D01D 5/06* (2013.01); *D01D 4/02* (2013.01); *D01D 5/253* (2013.01); *D01F 2/02* (2013.01); *D10B 2201/20* (2013.01)

(58) Field of Classification Search
CPC ..... D01D 5/06; D01D 4/02; D01D 5/253; D01D 2/00; D01F 2/02; B29C 48/278
See application file for complete search history.

(56) References Cited

U.S. PATENT DOCUMENTS 3,152,362 A * 10/1964 Carter ..... D01D 4/02 425/464
3,529,323 A * 9/1970 Hughey ..... D01D 5/253 425/382.2

(Continued)

FOREIGN PATENT DOCUMENTS

CN 107354518 A 11/2017
EP 0904431 A1 3/1999

(Continued)

OTHER PUBLICATIONS

European Search Report for Application No. EP21212307 dated Jun. 13, 2022.

(Continued)

*Primary Examiner* — Tajash D Patel
(74) *Attorney, Agent, or Firm* — MOSER TABOADA

(57) ABSTRACT

Disclosed is a process for spinning an alkaline cellulose spin dope, comprising dissolved cellulose, to cellulose filaments (10). The process comprising the steps of: —feeding the alkaline cellulose spin dope to at least one spinning head (20) with a plurality of holes (21), wherein the spinning head (20) comprises at least two parallel, rectangular spinneret dies (22), each with a plurality of holes (21), the spinneret dies (22) being arranged spaced apart with a flow spacing (23) in between them; —extruding the alkaline cellulose spin dope through the plurality of holes (21) into a flow (35) of aqueous alkaline coagulation bath liquid, the aqueous alkaline coagulation bath liquid comprising a sodium coagulation salt, whereby forming cellulose filaments (10), wherein the aqueous alkaline coagulation bath liquid flows (Continued)

Figure 1:
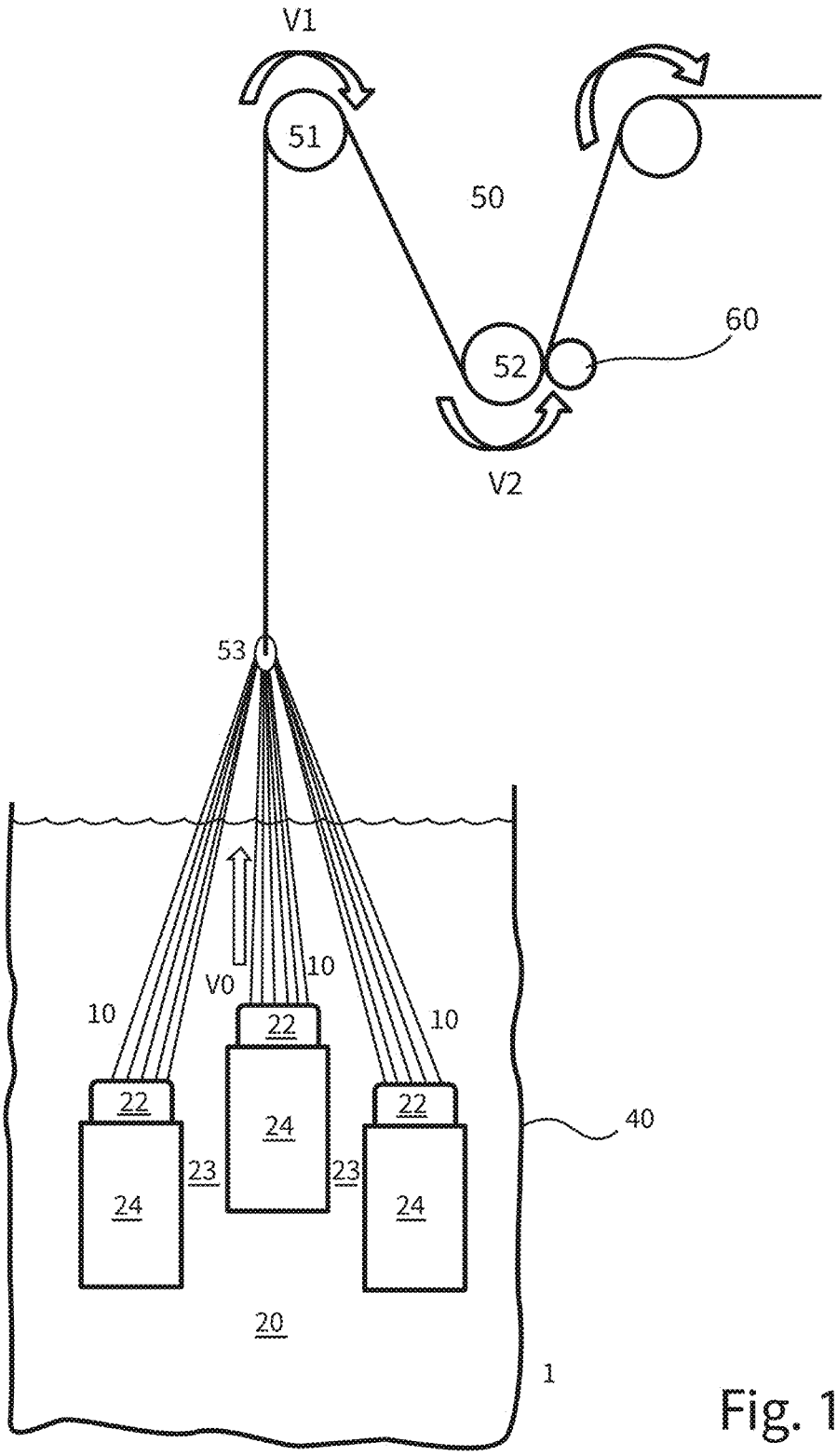

through the flow spacing (23) and then past the spinneret dies (22) in a flow direction, the flow direction of the aqueous alkaline coagulation bath liquid being parallel to the direction in which the alkaline cellulose spin dope is extruded into the aqueous alkaline coagulation bath liquid; and —withdrawing the cellulose filaments (10) from the aqueous alkaline coagulation bath liquid.

20 Claims, 16 Drawing Sheets

(51) Int. Cl.
*D01D 5/253* (2006.01)
*D01F 2/02* (2006.01)

(56) References Cited

U.S. PATENT DOCUMENTS

| | | | |
|---|---|---|---|
| 3,865,918 | A | 2/1975 | Mitchell et al. |
| 2005/0179162 | A1 | 8/2005 | Meerman et al. |
| 2019/0062950 | A1 | 2/2019 | Hedlund et al. |

FOREIGN PATENT DOCUMENTS

| | | | | | |
|---|---|---|---|---|---|
| EP | 4116469 | A1 | * | 1/2023 | ..... C08B 1/08 |
| JP | 2004360148 | A | | 12/2004 | |
| WO | WO-2010/104458 | A1 | | 9/2010 | |
| WO | WO-2015/000820 | A1 | | 1/2015 | |
| WO | WO-2017/178532 | A1 | | 10/2017 | |
| WO | WO-2018/169479 | A1 | | 9/2018 | |
| WO | WO-2018180188 | A1 | * | 10/2018 | ..... D01D 5/06 |
| WO | WO-2020/171767 | A1 | | 8/2020 | |
| WO | WO-2020222258 | A1 | * | 11/2020 | ..... D01D 10/06 |
| WO | WO-2022272013 | A1 | * | 12/2022 | ..... D01D 5/04 |

OTHER PUBLICATIONS

European Search Report for Application No. EP21183794 dated Dec. 13, 2021.
International Search Report for Application No. PCT/EP2022/068459 dated Nov. 3, 2022.

* cited by examiner

PROCESSING FOR SPINNING ALKALINE CELLULOSE SPIN DOPE

FIELD OF THE INVENTION

The present invention relates to a process for spinning cellulose dissolved in aqueous sodium hydroxide (NaOH) into cellulose filaments. In spinning the dissolved alkali cellulose, the alkali cellulose is extruded into a coagulation bath to precipitate cellulose, whereby forming cellulose filaments. Further, the invention relates to a system for use in such spinning.

BACKGROUND

Fibers have large application areas in the textile industries. Historically, textile fibers have been natural fibers. For example, cotton fibers have for long been used in textile industry for making fabric. In addition, other plant fibers, e.g. flax fibers, have been used. During the $20^{th}$ century, plastic fibers, e.g. nylon and polyester fibers, emerged as cheap alternative for producing fabric. Still, cotton fibers represent a very important fiber within the textile industries.

Given the desire to reduce the carbon footprint, the need for natural fibers is growing once more. However, also growing and processing of cotton causes environmental problems. Thus, the interest in alternative sources of cellulose to make fibers is growing.

The viscose process, known for long, uses wood as raw material for producing cellulose fibers. In the viscose process, regenerated cellulose fibers are provided by regeneration of sodium cellulose xanthate, i.e. cellulose derivatized by $CS_2$ (carbon disulphide) to increase the solubility. The use of carbon disulphide is however associated with problems including its toxicity. Further, $Na_2SO_4$, having no commercial values nowadays, is inevitably formed as a by-product in the viscose process as dissolved sodium cellulose xanthate is spun into aqueous sulfuric acid to precipitate cellulose fibers and to re-generate carbon disulphide. Thus, there is a desire within the art to find alternative processes for providing cellulose fibers from wood.

It is known in the art that non-derivatized cellulose to some extent is soluble in cold aqueous sodium hydroxide. Thus, aqueous sodium hydroxide has been used as cellulose solvent in experimental procedures, though no industrial process for fiber spinning, being economically feasible, is available so far.

In spinning experimental spin dopes comprising cellulose dissolved in aqueous sodium hydroxide, the spin dope has been wet-spun into a coagulation bath comprising aqueous sulfuric acid, as in the viscose process. While providing fibers, such a procedure suffers from requiring vast amounts of sodium hydroxide and produces, similar to the viscose process, sodium sulfate as a residue.

In order to address this problem, it has been suggested in the art (see for example WO 2020/171767, WO 2018/169479, WO 2017/178532, WO 2015/000820, WO 2010/104458 to the present applicant) to spin dissolved cellulose into an alkaline spinbath comprising an aqueous coagulation sodium salt solution, e.g. $Na_2CO_3$ or $Na_2SO_4$, and separately recovering sodium hydroxide (NaOH) and a sodium coagulation salt, respectively, from the spin bath. As the chemicals, i.e. NaOH and the coagulation sodium salt, may be recovered separately, the process is deemed promising.

The present applicant has indeed found that that cellulose dissolved in an aqueous sodium hydroxide solution to produce a spin dope, may be spun into a coagulation bath comprising an aqueous coagulation sodium salt solution, e.g. $Na_2CO_3$ or $Na_2SO_4$. A wet, swollen tow is provided when the spin dope is spun into the coagulation bath. The tow of regenerated fibers may subsequently be withdrawn from the coagulation bath to provide cellulose fibers. In the viscose process, the sodium cellulose xanthate is typically spun by means of a spinneret die—a small metal plate, thimble, or cap with fine holes through which the spin dope is forced in the spinning of filaments into an acidic coagulation bath. A number of spinneret dies, each with hundreds or thousands of fine holes, are typically arranged in a spinning head. The spinning head is designed to form thousands of thin spin dope jets exiting the spinning head and entering the coagulation bath liquid.

Upon contact with the coagulation liquid, there will be a diffusion-based exchange of chemicals between the spin dope jets exiting the spinning head and the coagulation liquid. The inter-diffusion of chemicals is a quick process since the spin dope jets exiting the holes of the spinneret dies are narrow (typically 40 to 100 μm in diameter). Upon contact between the spin dope jets and the coagulation liquid, protons will quickly enter the jets neutralizing the alkali forming sodium sulfate. The solvation power of alkali is thus abruptly decreased, and cellulose is precipitated, forming a dens, non-swollen network of semi-crystalline fibrils. Due to the very rapid precipitation (coagulation) of cellulose under the acidic conditions, the spin dope jets are transformed into thin, strong and non-swollen filaments directly upon exiting the spinneret holes. Without being bound to any theory, the rapid precipitation may at least partly be explained by the acidic conditions and the rapid diffusion of hydronium ions ($H_3O^+$).

These characteristics allow for many and densely spaced holes in each circular spinneret die. State-of-the-art spinneret dies (typically 16 mm in diameter) may have between 1800 and 2400 holes, each with a diameter of about 50-60 μm. The exit speed of the spin dope jets may typically be in the range of 30-50 m/min (average speed in the holes). The production rate from a spinning head with a diameter of 200 mm, provided with 45 spinneret dies, each having 2000 holes, may be in the range of 30 to 50 kg/h (1.3 dtex fibers).

However, compared to the viscose process using an acidic coagulation bath, the coagulation processes using an alkaline coagulation bath, comprising a coagulation salt (e.g. $Na_2SO_4$ or $Na_2CO_3$), differs from the acidic one. Especially, it has been found that the precipitated filaments remain swollen in the alkaline coagulation bath, the initial filaments thus having less structural integrity. These properties of the filaments allow for much lower production rates, using conventional spinneret dies. In order to avoid filament breaks, resulting in formation of filament lumps/coils, the exit speed has to be significantly decreased lowering the production rate, and/or the hole density (i.e. the distance between the holes) has to be lowered; both affecting the production rate negatively.

Thus, there is a need in the art for an efficient process for spinning cellulose dissolved in aqueous sodium hydroxide (NaOH) into cellulose filaments in an alkaline coagulation bath.

SUMMARY OF THE INVENTION

According to a first aspect of the invention there is provided a process for spinning an alkaline cellulose spin dope, comprising dissolved cellulose, to cellulose filaments by extruding the alkaline cellulose spin dope into an aqueous alkaline coagulation bath liquid, comprising a sodium coagulation salt, whereby forming cellulose filaments. The cellulose filaments are subsequently withdrawn from the aqueous alkaline coagulation bath liquid.

The process comprises the steps of:

feeding the alkaline cellulose spin dope to at least one spinning head with a plurality of holes;

extruding the alkaline cellulose spin dope through the plurality of holes into a flow of aqueous alkaline coagulation bath liquid, whereby forming cellulose filaments; and withdrawing the thus formed cellulose filaments from the aqueous alkaline coagulation bath liquid.

According to a second aspect of the invention there is provided a corresponding system for spinning an alkaline cellulose spin dope, comprising dissolved cellulose, into a flow of aqueous alkaline coagulation bath liquid, comprising a sodium coagulation salt, whereby forming cellulose filaments.

The method employs and the system comprises at least one spinning head with a plurality of holes for extruding the alkaline cellulose spin dope into the aqueous alkaline coagulation bath liquid. The spinning head comprises at least two rectangular spinneret dies, such as at least three, four, or five spinneret dies, each with a plurality of holes from which the alkaline cellulose spin dope is to be extruded. The spinneret dies are rectangular, i.e. they are longer than wider. They are arranged in parallel. Typically, the rectangular spinneret dies are long and narrow. Their length:width ratio may be at least 5:1. According to an embodiment, the length:width ratio is 5:1 to 200:1, such as 10:1 to 100:1. The length is the longest dimension from one end of the spinneret die to the other. The width is the longest dimension perpendicular to the length. Typically, the rectangular spinneret dies each has a continuous rectangular surface with numerous holes. However, according to an alternative embodiment, the rectangular spinneret dies each comprises a number of spin caps (circular spinneret dies) arranged in a row to form a rectangular spinneret die.

The spinneret dies are arranged spaced apart to form flow spacing(s) in between them. By having such flow spacing(s), the aqueous alkaline coagulation bath liquid may flow in between the spinneret dies in a direction parallel to the direction in which the alkaline cellulose spin dope is extruded into the aqueous alkaline coagulation bath liquid, whereby the alkaline cellulose spin dope may be extruded into a flow of aqueous alkaline coagulation bath liquid. Thus, the aqueous alkaline coagulation bath liquid flows through the flow spacing and then past the spinneret dies. Typically, the aqueous alkaline coagulation bath liquid flows vertically upwards. The system is thus typically arranged such that the aqueous alkaline coagulation bath liquid flows vertically upwards. Therefore, the flow spacing(s) may extend vertically. Further, the direction in which the alkaline cellulose spin dope is extruded into the aqueous alkaline coagulation bath liquid may be vertically upwards.

The formation of cellulose filaments in an alkaline coagulation bath liquid differs from the one in an acidic coagulation bath liquid. In an acidic coagulation bath liquid, the extruded cellulose spin dope rapidly forms dense filaments, whereas the filaments formed in alkaline coagulation bath liquid are less dense, initially having lower structural integrity. By extruding the alkaline cellulose spin dope through the plurality of holes into a flow of aqueous alkaline coagulation bath liquid, the resulting filaments are subject to less flow forces perpendicular to the spinning direction (i.e. the extrusion direction). Thus, the filaments remain intact also at higher extrusion rates, whereby higher production rates may be obtained.

In extruding the alkaline cellulose spin dope through the plurality of holes into the flow of aqueous alkaline coagulation bath liquid, the aqueous alkaline coagulation bath liquid flows past the spinning head in a flow direction essentially parallel to the direction in which the alkaline cellulose spin dope is extruded into the flow of aqueous alkaline coagulation bath liquid.

A conventional spinning head is typically circular and comprises a number of circular spinneret dies. The design of a conventional spinning head does only allow for flow passing past by the spinning head at its circumference, not in between each spinneret die. Further, the distance from a hole in the center of a circular spinneret die to the circumference is typically at least 8 mm. This conventional design has however been found to result in a significant flow of alkaline coagulation bath liquid radially over the surface of a circular spinneret die, exerting flow forces on the forming cellulose filaments resulting in filament break and lump formation unless lowering the spinning rate substantially.

In order to reduce the flow forces exerted on the forming cellulose filaments, the spinning head may comprise at least two spinneret dies, such as at least three, at least four, or at least five spinneret dies, each with a plurality of holes from which the alkaline cellulose spin dope is extruded. According to an embodiment, the spinning head comprises three to seven spinneret dies. The spinneret dies are arranged in parallel and spaced apart forming flow spacings in between them. The aqueous alkaline coagulation bath liquid thus flows in between the spinneret dies in the flow spacing(s). Further, to reduce the distance from the center of the spinneret die to the flow of alkaline coagulation bath liquid, the spinneret dies are rectangular. The length:width ratio may be at least 5:1. The length:width ratio may be 5:1 to 200:1, such as 10:1 to 100:1. A number of such rectangular spinneret dies arranged in parallel and spaced apart, with a flow spacing in between them, provides for flow of alkaline coagulation bath liquid close to each and every hole in the spinning head. The width of the rectangular spinneret die may be 10 mm or less, such as 0.5 to 7 mm, 1 to 6 mm, or 1.5 to 5 mm. Further, the holes in the rectangular spinneret die are typically arranged in a rectangular group of holes. The holes may be arranged such that width of a rectangular group of holes does not exceed 4 mm, preferably not exceeds 3 mm. According to an embodiment, the holes are arranged such that width of a rectangular group of holes is 0.4 to 4 mm, such as 1 to 3 mm. Thus, the distance from a hole in the center of the rectangular spinneret die to its edge is typically shorter than the corresponding distance in a conventional circular spin cap. Further, the center-to-center distance of two neighboring spinneret dies arranged in parallel may be 8 to 30 mm.

The spinning head may comprise at least two plates arranged in parallel, each having a spinneret die arranged at a rectangular edge of the plate. Whereby the holes of the spinneret die are arranged at a rectangular edge of each plate. The thickness of the plate may be tapered adjacent to this edge, if the plate is thicker than the width of the spinneret die, in order to avoid inducing turbulence. Typically, the holes are arranged to face upwards, whereby the alkaline cellulose spin dope may be extruded vertically upwards. According to such an embodiment, each plate is provided with flow channels for receiving alkaline cellulose spin dope from a feeding line, to distribute and fed it to the dies with the holes. The plates may be provided by 3D-printing. The plates may be 5 to 50 cm long. The thickness of the plate does typically exceed the width of the rectangular spinneret die arranged at a rectangular edge of each plate. The plate may be 5 to 15 mm thick. Further, the free distance between two neighboring plates arranged in parallel may be 3 to 10 mm, such as 5 to 8 mm. The resulting flow spacing(s) between the plates may thus have a width of 3 to 10 mm, such as 5 to 8 mm.

The holes in the spinning head may have a diameter of 40 to 100 μm. Further, the center-to-center distance of neighboring holes may be 200 to 600 μm, such as 250 to 400 μm. The holes may be homogenously distributed on the spinneret die, e.g. hexagonally or in a square pattern. Distributing the holes in a square pattern may reduce the hydrodynamic forces between filaments and the aqueous alkaline coagulation bath liquid that flows in across the spinneret die surface.

Further, the holes may also be heterogeneously distributed on the spinneret die. Distributing the holes heterogeneously may reduce the hydrodynamic forces between filaments and the aqueous alkaline coagulation bath liquid that flows in across the spinneret die surface. The average center-to-center distance of two neighboring holes in a group may be 200 to 600 μm, such as 250 to 400 μm, also with heterogeneously distributed holes.

The withdrawal of the cellulose filaments from the aqueous alkaline coagulation bath liquid induces self-convection of the aqueous alkaline coagulation bath liquid having it to flow in the same direction as the filaments. Further, also the extrusion of the alkaline cellulose spin dope into the aqueous alkaline coagulation bath liquid will promote self-convection of the aqueous alkaline coagulation bath liquid. Thus, the aqueous alkaline coagulation bath liquid flows, at least partly, by self-convection resulting from the extrusion of the alkaline cellulose spin dope into the aqueous alkaline coagulation bath liquid and from the withdrawal of the cellulose filaments from the aqueous alkaline coagulation bath liquid. According to an embodiment, the aqueous alkaline coagulation bath liquid flows solely by self-convection, i.e. no active flow directing means (e.g. a pump) is used. As aqueous alkaline coagulation bath liquid flows away from the spinneret dies, aqueous alkaline coagulation bath liquid will also have to flow towards the spinneret dies.

According to an embodiment, the system comprising the spinning head is arranged to reduce flow of aqueous alkaline coagulation bath liquid across the rectangular spinneret dies. Further, or alternatively, the system is arranged to guide the flow of aqueous alkaline coagulation bath liquid, in passing the rectangular spinneret dies, to be parallel to the direction in which the alkaline cellulose spin dope is extruded.

In order to:

a) reduce flow of aqueous alkaline coagulation bath liquid across the rectangular spinneret dies;
b) guide the flow of aqueous alkaline coagulation bath liquid, in passing the rectangular spinneret dies, to be parallel to the direction in which the alkaline cellulose spin dope is extruded;
c) keep cellulose filaments from a first rectangular spinneret die apart from filaments from a second rectangular spinneret die; and/or
d) promote and direct self-convection of aqueous alkaline coagulation bath liquid the system comprising the spinning head may be provided with various flow directing means, such as a screen, an endplate, and/or a deflector plate, and/or be arranged to direct the flow, as further outlined herein below.

In order to provide support for a flow of aqueous alkaline coagulation bath liquid past the spinning head, a system comprising the spinning head may be provided with a flow directing means. The flow directing means may be an active means, such as a pump pumping aqueous alkaline coagulation bath liquid past the spinning head. However, the flow directing means is preferably a passive means, such as a screen, an endplate, and/or deflector plate.

Generally, it was found advantageous to restrict flow of aqueous alkaline coagulation bath liquid across the spinneret die. Further, it was found advantageous to restrict incoming flow of aqueous alkaline coagulation bath liquid towards the short side and/or towards the long side of a given spinneret die, i.e. perpendicular to the direction in which the alkaline cellulose spin dope is extruded. Restricting the flow in any of these directions will support a flow of aqueous alkaline coagulation bath liquid in a direction parallel to the direction in which the alkaline cellulose spin dope is extruded. Further, it will reduce, or even eliminate, mechanical strain on newly formed filaments close to the spinneret dies, as the restrict flow of aqueous alkaline coagulation bath liquid across the spinneret die. Furthermore, restricting flow of aqueous alkaline coagulation bath liquid perpendicular to the direction in which the alkaline cellulose spin dope is extruded will reduce, or even eliminate, turbulent flow close to the spinneret dies, as well as downstream of the spinneret dies.

Further, also the flow spacing in between the spinneret dies supports a flow of aqueous alkaline coagulation bath liquid in a direction parallel to the direction in which the alkaline cellulose spin dope is extruded.

According to an embodiment, a first rectangular spinneret die is arranged downstream, or upstream, of a neighboring second rectangular spinneret die. Thus, the first rectangular spinneret die and the second rectangular spinneret die may be arranged e.g. on different vertical levels. By arranging the spinneret dies in this manner, one of the spinneret dies will reduce flow of aqueous alkaline coagulation bath liquid across the other spinneret die.

Typically, the spinning head comprises at least three parallel, rectangular spinneret dies. Thus, a first and a third rectangular spinneret die may be arranged upstream of the second rectangular spinneret die, e.g. on a lower vertical level. If arranged in this manner, the second rectangular spinneret die may be arranged in between the first and the third spinneret die, the second rectangular spinneret die thereby reducing flow of aqueous alkaline coagulation bath liquid across the first and the third spinneret die. Three or more parallel, rectangular spinneret dies, may be arranged in a pyramidal manner.

In a spinning head comprising at least four parallel, rectangular spinneret dies, a first and a third rectangular spinneret die may further be arranged upstream, e.g. on a lower vertical level, of a second and a fourth rectangular spinneret die. If arranged in this manner, the second rectangular spinneret die may be arranged in between the first and the third rectangular spinneret die, and the fourth spinneret die may be arranged next to the third spinneret die on a side opposite to the second spinneret die. Four or more parallel, rectangular spinneret dies, may be arranged in a zig-zag pattern. Further, as already described, four or more parallel, rectangular spinneret dies, may be arranged in a pyramidal manner.

Furthermore, in a spinning head comprising at least three parallel, rectangular spinneret dies, such as at least five rectangular spinneret dies, the center-to-center distance between neighboring spinneret dies may differ by grouping the spinneret dies. The center-to-center distance between neighboring spinneret dies in a group may be less than the distance between neighboring spinneret dies in different groups. The center-to-center distance between neighboring spinneret dies in the same group may be 8 to 24 mm, whereas the center-to-center distance between neighboring spinneret dies in different groups may be 14 to 30 mm.

According to an embodiment, a screen is arranged in between two neighboring rectangular spinneret dies. The screen extends at least downstream of the rectangular spinneret dies, whereby it keeps the cellulose filaments from a first rectangular spinneret die apart from filaments from a second rectangular spinneret die. The screen may extend at least 10 mm, such as at least 25 mm, or at least to 50 mm, downstream of the spinneret dies. The screen may extend 10 mm to 300 mm, such as 25 to 150 downstream of the spinneret dies. Further, the screen may extend upstream the spinneret dies. Preferably, the screen extends less than 10 mm upstream of the spinneret dies. The screen may for example be a plastic sheet or a metallic plate. The screen may be 0.5 to 5 mm thick (a metallic plate may typically be thinner than a plastic sheet) and the width of the screen may correspond to the length of the spinneret die. Given that the structural integrity of the cellulose filaments develops gradually over the extrusion, it is advantageous to keep cellulose filaments from different spinneret dies separate initially. Further, the screen also reduces flow of aqueous alkaline coagulation bath liquid across the spinneret dies. Importantly, the screens stabilize the flow downstream the spinneret dies and minimize, or even eliminate, any turbulent flow. Screens may be combined with arranging the spinneret dies at different vertical levels. Further, screens may be used to separate neighboring groups of spinneret dies. Furthermore, screens may also be used as an alternative to arranging the spinneret dies at different vertical levels.

According to an embodiment, the parallel, rectangular spinneret dies are arranged in between a first endplate and a second endplate. The endplates extend from the spinneret dies in the flow direction, i.e. downstream of the spinneret dies. Further, they are perpendicularly arranged to the longitudinal extension of the rectangular spinneret dies. According to such an embodiment the parallel, rectangular spinneret dies extend from the first endplate to the second endplate. As the endplates extend downstream of the spinneret dies in the flow direction, flow of aqueous alkaline coagulation bath liquid from the short ends of the spinneret dies along their longitudinal extension is hindered. Further, endplates will support a laminar flow of aqueous alkaline coagulation bath liquid and lower any tendency to local turbulent flow. The endplates may be combined with screens. If combined with screens, the screens may be secured to the endplates.

According to an embodiment, the spinning head is arranged in between two deflector plates. The deflector plates are similar to the screens, as they are arranged on one side of a spinneret die. They are however arranged on the outside of the outermost spinneret dies. Outer flow spacings may be present between the outermost spinneret dies and the deflector plates. Similarly, outer flow spacings may be present between outermost plates having a spinneret die arranged at a rectangular edge of the plate and the deflector plates. The outer flow spacings may have a width of 3 to 10 mm, such as 5 to 8 mm. The width of the outer flow spacings is typically the same or less than width of the flow spacings in between the spinneret dies. The deflector plates are arranged in parallel with the longitudinal extension of the spinneret dies and they extend downstream of the rectangular spinneret dies. Thus, the deflector plates hinder incoming flow of aqueous alkaline coagulation bath liquid in a direction perpendicular to the longitudinal extension of the rectangular spinneret dies, and to the direction in which the alkaline cellulose spin dope is extruded. The deflector plates are typically symmetrically arranged around the spinning head. The deflector plates may be planar, bent or curved. According to an embodiment, planar deflector plates are arranged in parallel. It might in some embodiments be beneficial to provide a tapered spacing between the deflector plates, at least along a portion of the length of the deflector plates. Thus, the distance between the deflector plates may decrease downstream the spinneret dies. Such tapered and reduced deflector-plate-to-plate distance has the effect to gradually reduce the cross section of the outlet of the volume confined between the deflector plates. Planar deflector plates may be tiltedly arranged relative each other such that distance between them decreases downstream the spinneret dies. The angle between planar deflector plates tiltedly arranged relative each other may be 5 to 75°, such as 15 to 60°. Consequently, also the flow through the confined volume is constricted along with the incoming flow rate and velocity, between the spinneret dies. This reduction in flow speed significantly reduces the turbulence and propensity for whirls to arise around downstream of the spinnerets, where unstable flow can damage the fibers. The distance between the deflector plates at an end downstream and distal to the spinneret dies, i.e. an outlet end, may be based on the aggregate area of the rectangular spinneret dies (or alternatively the aggregate area of the capillary covered surface of the spinneret dies), or actually the aggregate width of the spinneret dies, as the length of the spinneret dies typically equal the width of the deflector plates. According to an embodiment, the distance between the deflector plates at an end downstream and distal to the spinneret dies, i.e. an outlet end, is at least 5 mm. Further, the distance between the deflector plates at an end downstream and distal to the spinneret dies, i.e. an outlet end, may be 0.3 to 1.2 times the aggregate width of the spinneret dies. For five spinneret dies, each having a width of 4 mm, the distance between the deflector plates at an end downstream and distal to the spinneret dies, i.e. an outlet end, may thus be 5×4×0.3=6 mm to 5×4×1.2=24 mm; preferably, the distance between the deflector plates at an end downstream and distal to the spinneret dies, i.e. an outlet end, is at least 5 mm. According to an alternative embodiment, the distance between the deflector plates at an end downstream and distal to the spinneret dies, i.e. an outlet end, is 0.5 to 2 times the aggregate width of the capillary covered surface of the spinneret dies. For five spinneret dies, each having a width of 4 mm, of which 2.4 mm contains the capillaries, the distance between the deflector plates at an end downstream and distal to the spinneret dies, i.e. an outlet end, may thus be 5×2.4×0.5=6 mm to 5×2.4×2=24 mm.

The deflector plates may be combined with, and optionally secured to, the endplates to form an extrusion channel. Thus, the spinning head may be arranged within an extrusion channel extending downstream of the spinneret dies.

Furthermore, a number of spinning heads, such as three to ten spinning heads, each spinning head comprising a number of rectangular spinneret dies, such as three to seven rectangular spinneret dies, may be grouped together to provide an arrangement of spinning heads. Alkaline cellulose spin dope may be fed to such an arrangement by a common pump. The center-to-center distance between neighboring spinneret dies in a given spinning head is typically less than the distance between spinneret dies in different spinning heads. The center-to-center distance between neighboring spinneret dies in a given spinning head may be 8 to 24 mm, whereas the center-to-center distance between neighboring spinneret dies in different spinning heads may be 14 to 30 mm. In an embodiment, wherein a number of spinning heads are grouped together to provide an arrangement of spinning heads, each spinning head may be provided with deflector plates, endplates and/or screen(s). Further, in a given spinning head, a first rectangular spinneret die may be arranged downstream, or upstream, of a neighboring, second rectangular spinneret die.

The system typically comprises withdrawal means for withdrawing the cellulose filaments from the aqueous alkaline coagulation bath liquid. The withdrawal means may comprise a rotating take up godet roller for drawing the filaments from the alkaline coagulation bath liquid. Further, the withdrawn filaments may be brought together into a tow, preferably upstream the take up godet roller, by means of an eyelet. The withdrawal means may further comprise a press for pressing aqueous alkaline coagulation bath liquid from the cellulose filaments subsequent to withdrawal from the coagulation bath. Furthermore, the withdrawal means may comprise further roller(s). A stretching roller may be arranged downstream of the take up godet roller. If the velocity at the surface of the stretching roller is higher than the velocity at the surface of the take up godet roller, the filaments may be stretched.

In fiber spinning, the draft ratio is defined as V1/V0, wherein V0 is the exit speed from the spinneret die (V0=spin dope flow rate in a spinneret hole/hole area) surface and V1 is the withdrawal speed, typically defined by the take up speed at the godet roller, i.e. the velocity at the surface of the rotating take up godet roller. For circular spinneret dies, the draft ratio typically needs to be <1 (typically <0.8), especially if spinning in an alkaline coagulation bath liquid in order to avoid the breakage of the filaments. However, with a rectangular spinneret die, it was unexpectedly found that a higher draft ratio may be used without resulting breakage of the filaments. Thus, it becomes possible to fine-tune the draft ratio in order to improve the properties of the resulting filaments. Further, as the draft ratio affects the diameter of the filaments, a wider range for the draft ratio implies that filaments with a wider range of diameters may be provided with a given hole diameter.

According to an embodiment, the spinning head is present within a vessel for aqueous alkaline coagulation bath liquid. The vessel may comprise a plurality of spinning heads arranged adjacent to each other. Thus, the vessel may comprise an arrangement of spinning heads as described herein above.

The composition of the aqueous alkaline coagulation bath liquid as well the alkaline cellulose spin dope may be in accordance with the typically composition within the art.

According to an embodiment, the aqueous alkaline coagulation bath liquid, upon extruding the alkaline cellulose spin dope into it, comprises 10 to 30 wt. % sodium coagulation salt, e.g. sodium carbonate ($Na_2CO_3$) and/or sodium sulfate ($Na_2SO_4$), such as 15 to 25 wt. % sodium coagulation salt, e.g. sodium carbonate ($Na_2CO_3$) and/or sodium sulfate ($Na_2SO_4$). Further, the temperature of the aqueous alkaline coagulation bath liquid, upon extruding the alkaline cellulose spin dope into it, may be 20° C. to 50° C., preferably 25° C. to 40° C.

According to an embodiment, the alkaline cellulose spin dope may have one or more of the following characteristics:

comprising 4 to 12 wt. %, preferably 5 to 8 wt. % cellulose; and/or the cellulose therein having a DP of 140 to 600, such as 180 to 600, 200 to 400, 160 to 400, or 180 to 300; and/or the cellulose therein having an intrinsic viscosity according to ISO5351:2010(E) of 115 to 450 ml/g, such as 150 to 450 ml/g, 190 to 300 ml/g, 130 to 300 ml/g, or 140 to 230 ml/g; and/or having a viscosity measured at room temperature (i.e. 20° C.) and at a shear rate of 0.2 $s^{-1}$ of 1 to 200 Pas, preferably 1 to 50 Pas; and/or the cellulose therein having a degree of substitution DS of not more than 0.3, preferably not more than 0.1; and/or;

comprising 5 to 10 wt. % NaOH, preferably 6.5 to 8.5 wt. % NaOH. Further, temperature of the alkaline cellulose spin dope upon extruding it into the aqueous alkaline coagulation bath liquid is 5° C. to 30° C., preferably 10° C. to 25° C.; and/or Without further elaboration, it is believed that one skilled in the art may, using the preceding description, utilize the present invention to its fullest extent. The preceding preferred specific embodiments are, therefore, to be construed as merely illustrative and not limitative of the disclosure in any way whatsoever.

Although the present invention has been described above with reference to specific embodiments, it is not intended to be limited to the specific form set forth herein. Rather, the invention is limited only by the accompanying claims and other embodiments than the specific embodiments described above are equally possible within the scope of these appended claims.

In the claims, the term "comprises/comprising" does not exclude the presence of other elements or steps. Additionally, although individual features may be included in different claims, these may possibly advantageously be combined, and the inclusion in different claims does not imply that a combination of features is not feasible and/or advantageous.

In addition, singular references do not exclude a plurality. The terms "a", "an", "first", "second" etc. do not preclude a plurality.

DRAWINGS

Figure 2A:
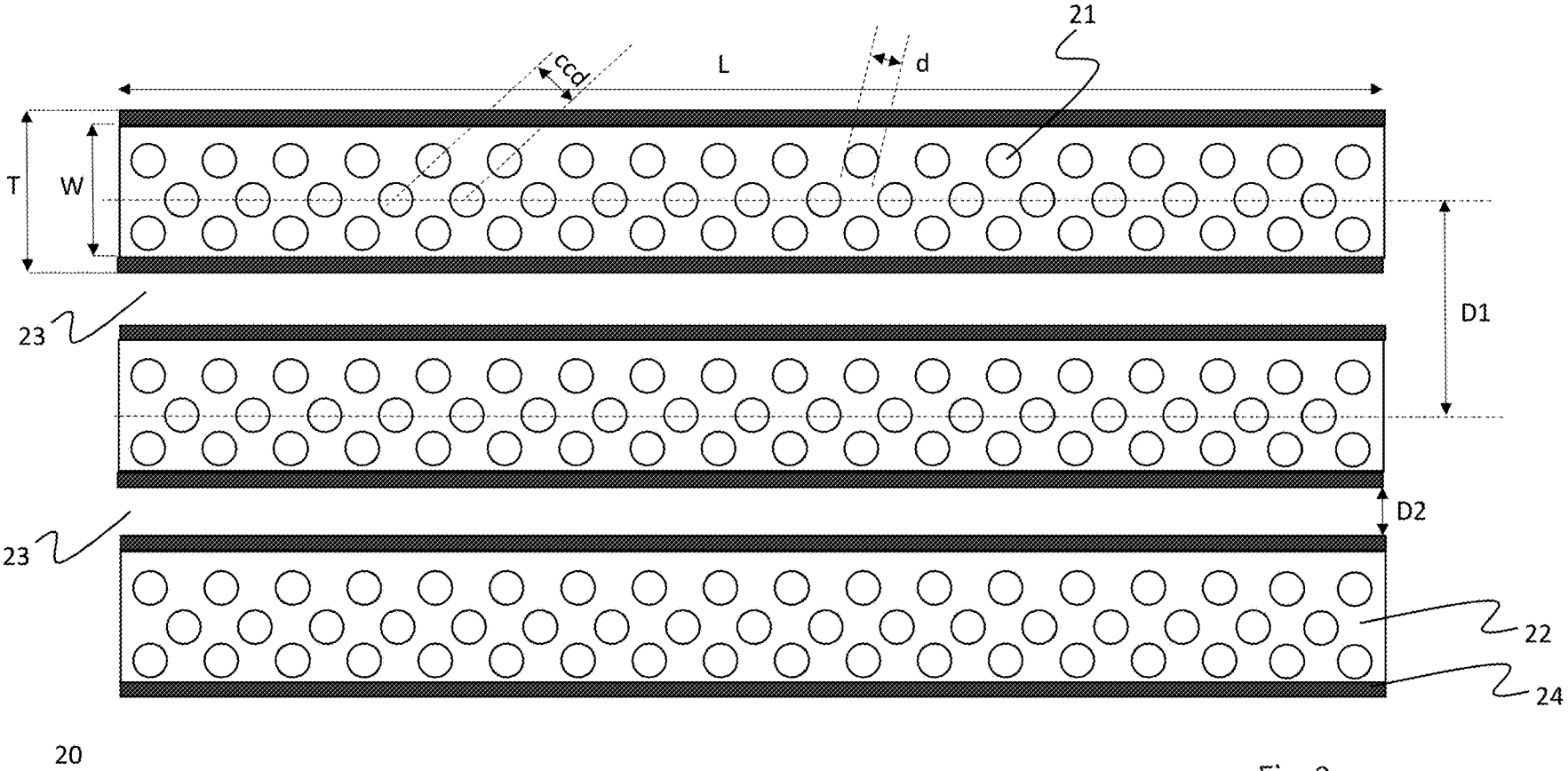
Figure 2B:
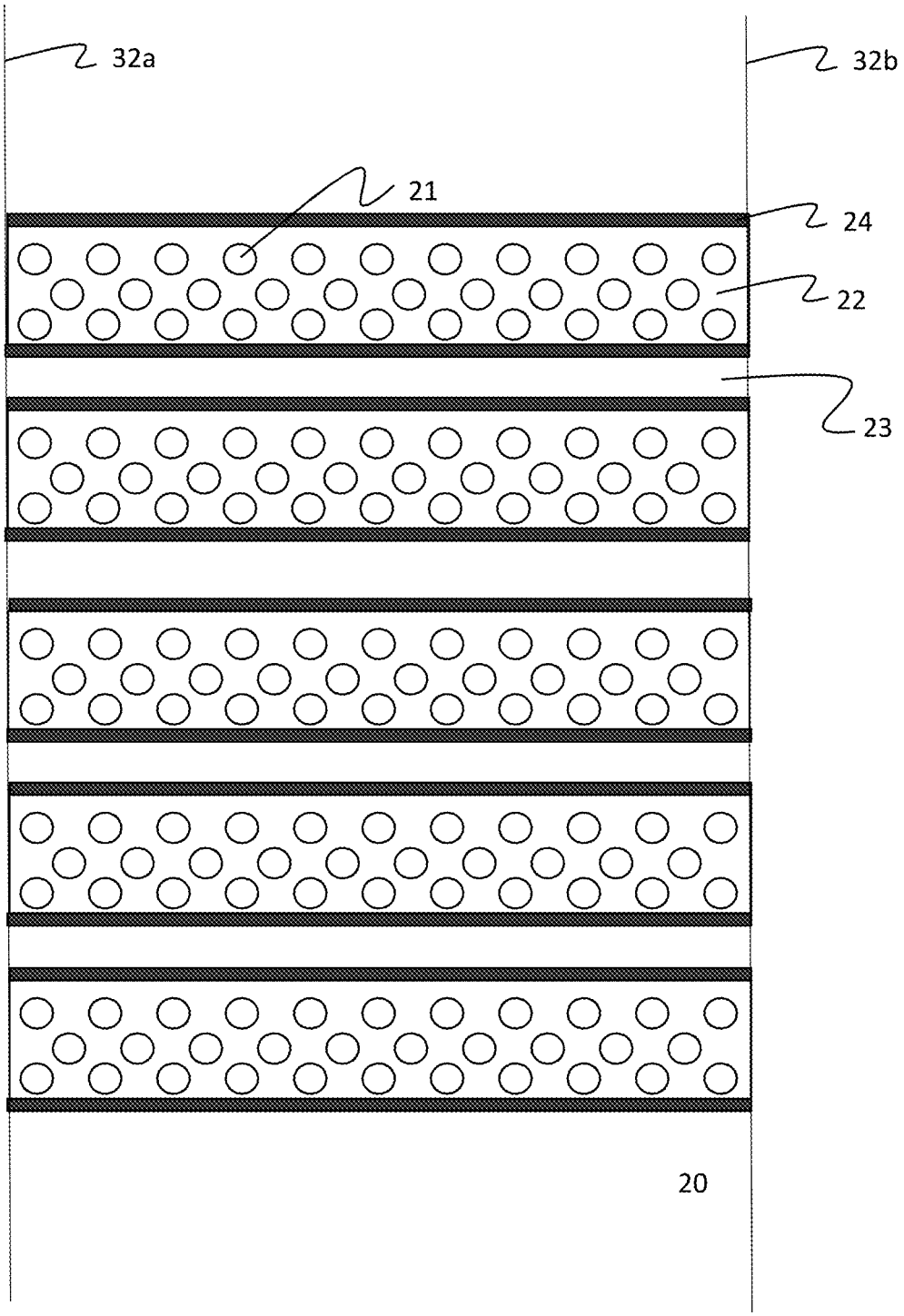
Figure 4:
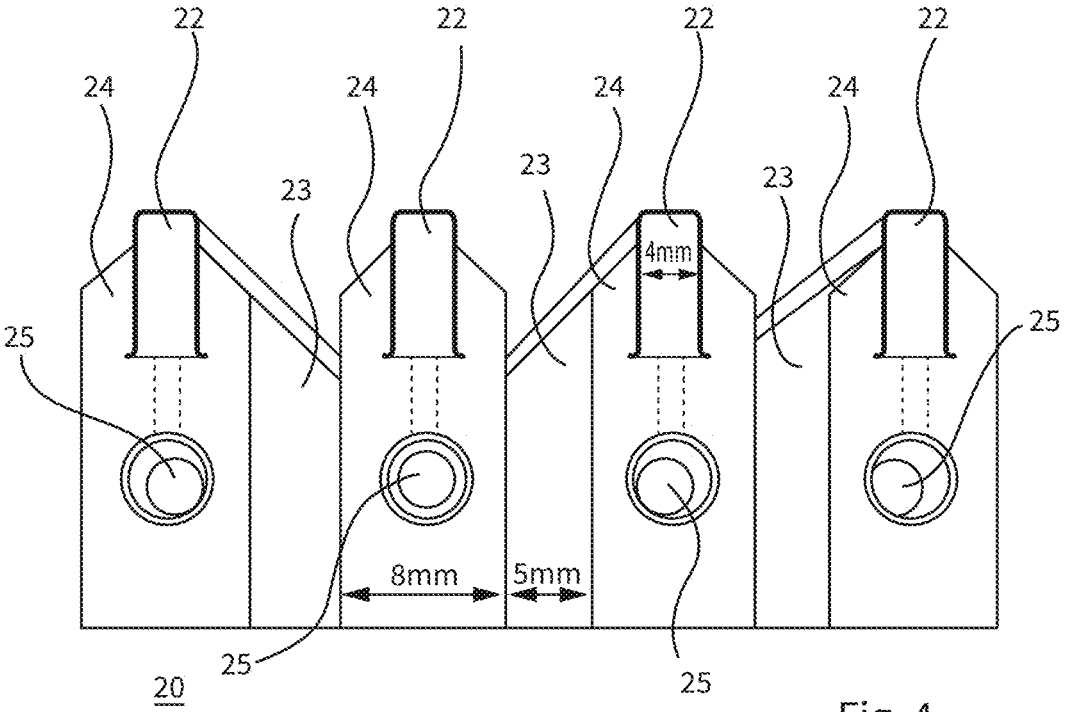
Figure 5:
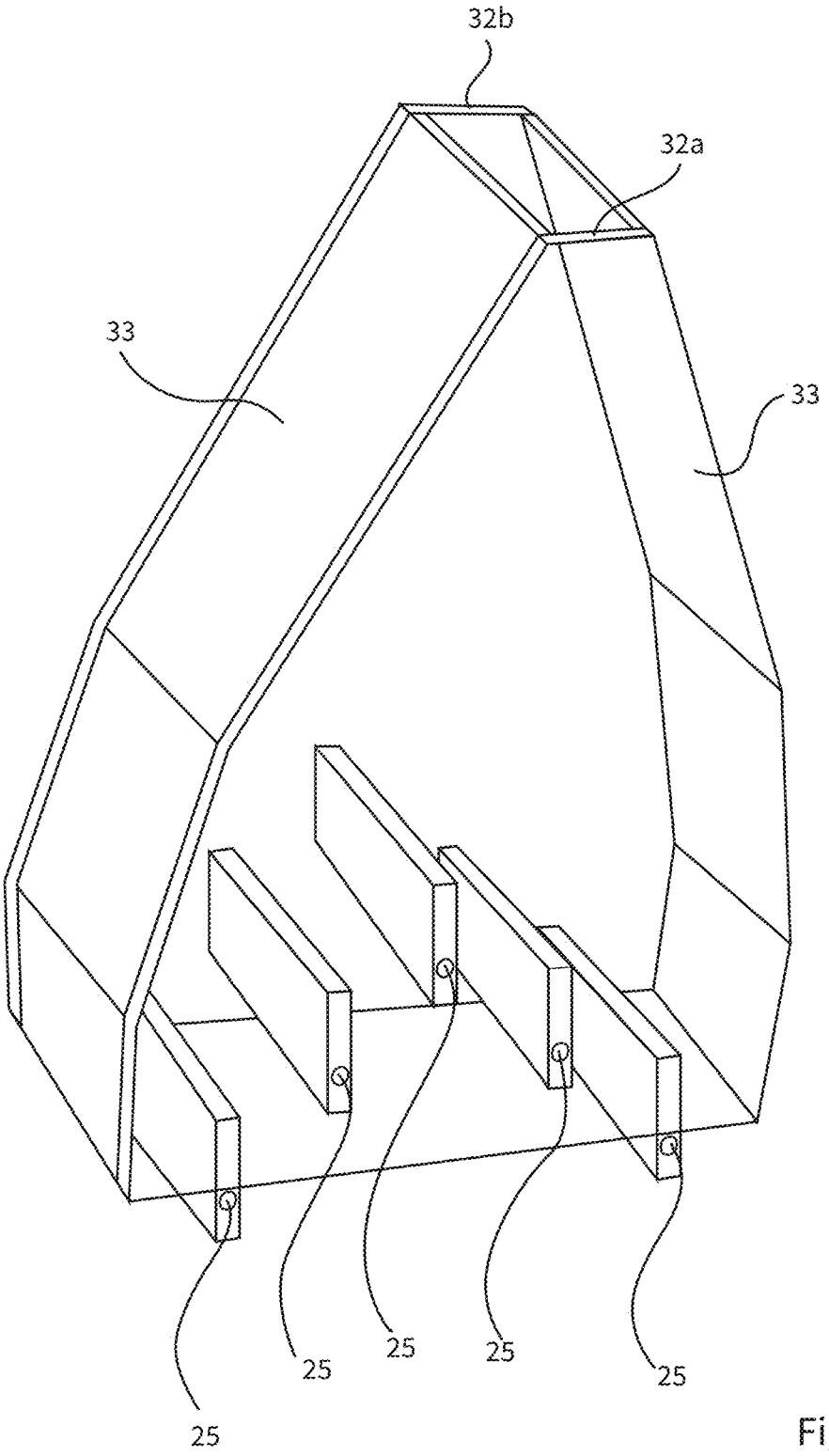
Figure 6:
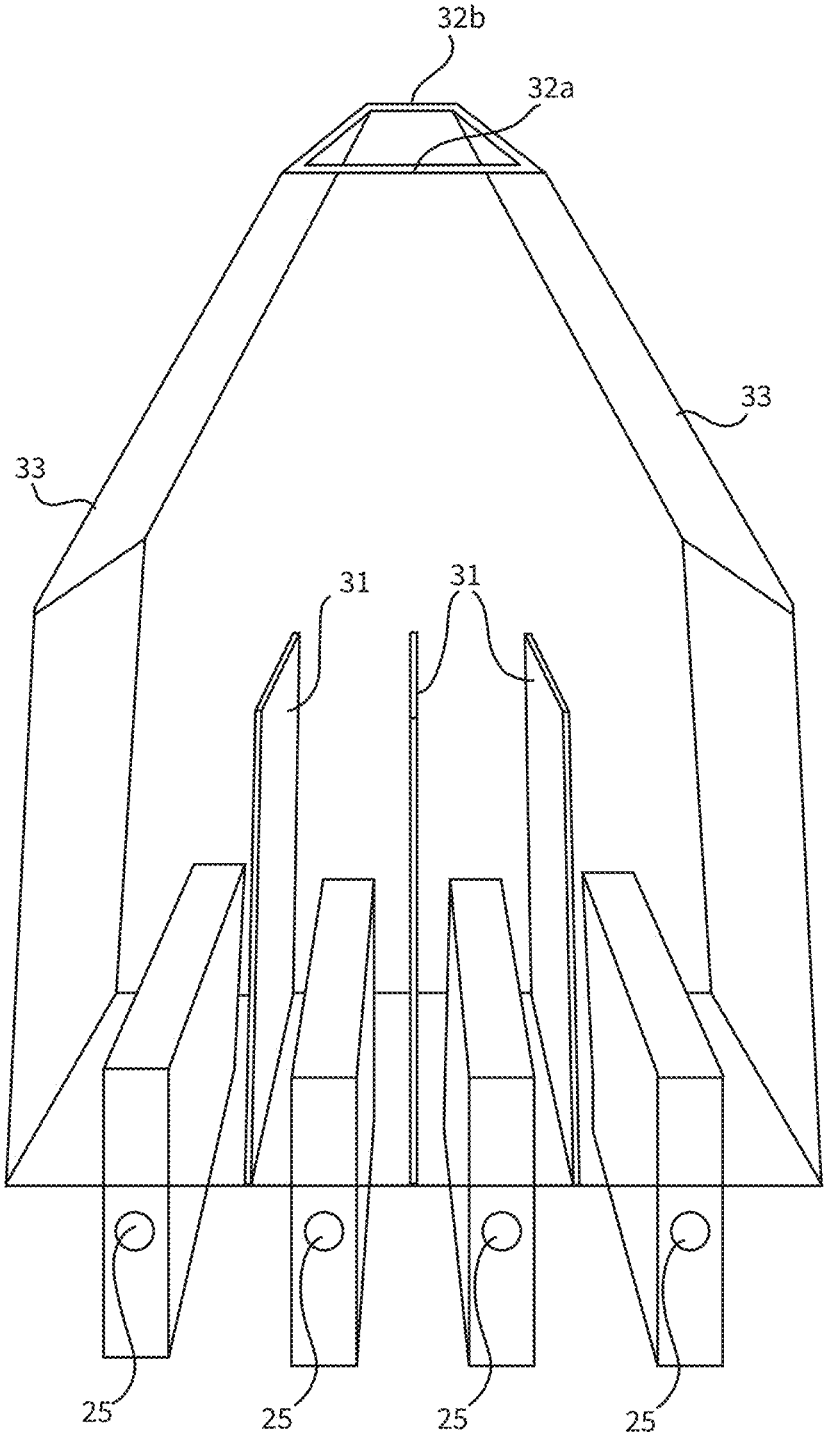
Figure 7:
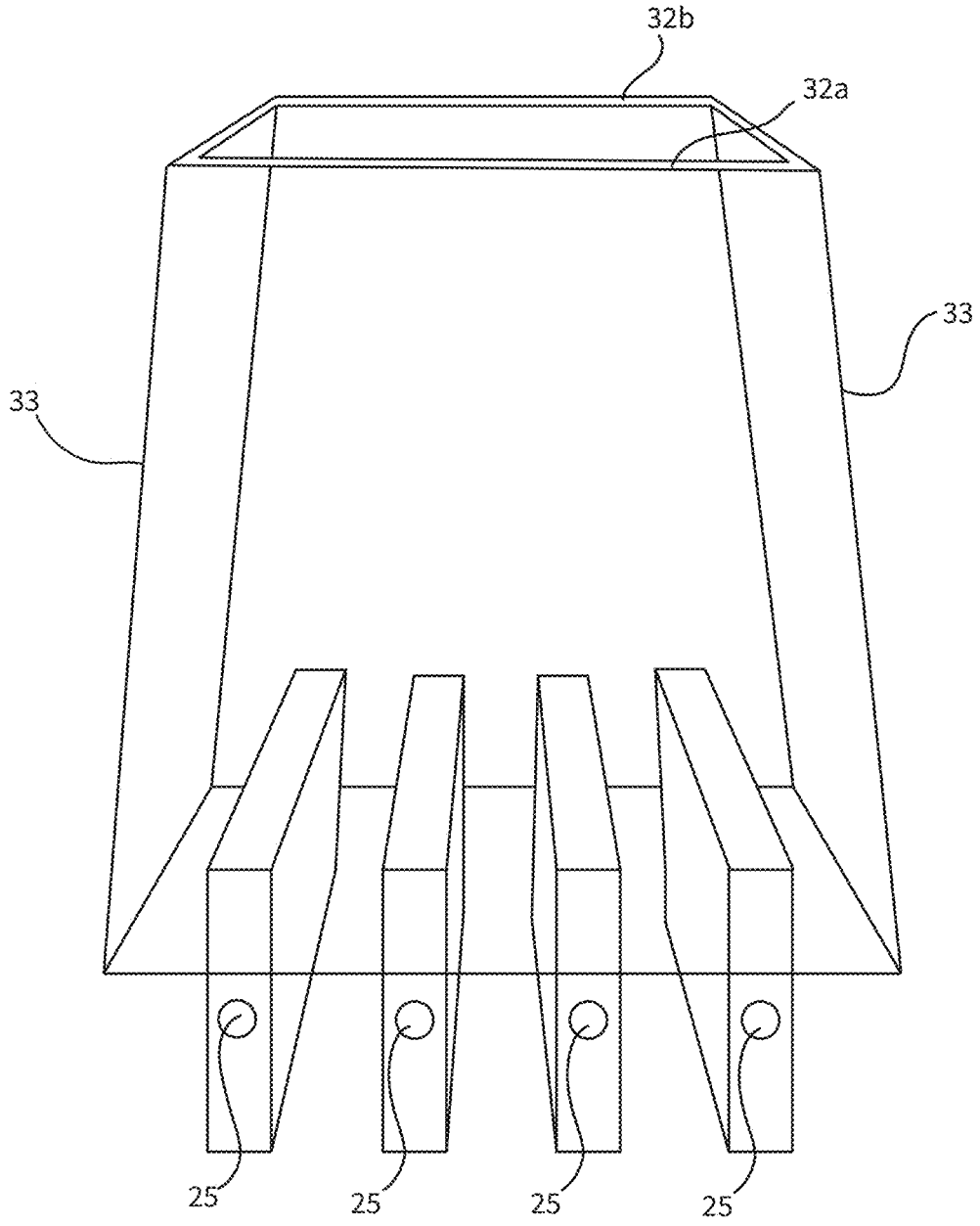

FIG. 1 Depicts a schematic side view of spinning from a spinning head with three spinning dies, wherein the formed filaments are taken up by a godet roller;

FIG. 2*a* is a top view of a spinning head, according to an embodiment, with three rectangular spinneret dies showing various measurements;

FIG. 2*b* is a top view of a spinning head, according to an embodiment, with five rectangular spinneret dies, the spinneret dies extending between two end-plates;

FIG. 3*a-i* depict side views of spinning systems according to different embodiments;

FIG. 4 The photograph in FIG. 4 shows a side view of a pilot spinning head with four parallel spinning dies. In order to visualize the spinning dies, the spinning head is shown with dismounted edge sealing plate. Further, it is also shown without any means for directing the flow of aqueous alkaline coagulation bath liquid;

FIG. 5 The photograph in FIG. 5 shows a side view of a pilot spinning head with five pyramidal arranged spinning dies and two deflector plates;

FIG. 6 The photograph in FIG. 6 shows a side view of a pilot spinning head with four spinning dies arranged on the same vertical level, screens 31 arranged in between in the spinning dies, and two deflector plates;

FIG. 7 The photograph in FIG. 7 shows a side view of a pilot spinning head with four spinning dies arranged on the same vertical level and two deflector plates

DETAILED DESCRIPTION

FIG. 1 shows a side view of a spinning system according to an embodiment. A spinning head 20 is provided with three pyramidally arranged, rectangular spinneret dies 22. The spinneret dies 22 with holes 21 (not shown in FIG. 1) for extruding alkaline cellulose spin dope there through at a spin dope flow rate V0, are arranged at a rectangular edge of plates 24. As can be seen in FIG. 4, the spinneret dies 22 may be U-profiles arranged in a slit in the plate 24. The plates 24 are arranged spaced apart with flow spacing(s) 23 in between them in which the aqueous alkaline coagulation bath liquid may flow (cf. FIG. 3). A flow 35 of aqueous alkaline coagulation bath liquid may thus flow (cf. FIG. 3) in the flow spacing(s) 23. Upon extruding alkaline cellulose spin dope through the holes 21 into an aqueous alkaline coagulation bath liquid, cellulose filaments 10 are formed. In FIG. 1, the cellulose filaments 10 are drawn upwards by withdrawal means 50. The withdrawal means 50 may comprise an eyelet 53 for bringing the filaments 10 together into a tow. Further, the withdrawal means 50 comprises a rotating take up godet roller 51 for withdrawing the cellulose filaments 10 from the aqueous alkaline coagulation bath liquid. The rotation speed V1 (i.e. the velocity at the surface of the rotating take up godet roller 51) of the rotating take up godet roller 51 determines the withdrawal speed. Further, the withdrawal means 50 may comprise a rotating stretching roller 52 for stretching the cellulose filaments 10 in between the take up godet roller 51 and the stretching roller 52. The stretch ratio is defined as the ratio of the rotation speed V2 of the stretching roller 52 and the rotation speed V1 of the rotating take up godet roller 51.

In FIG. 2*a* some measurements and dimensions of the spinning head 20 are illustrated. The center-to-distance "ccd" between neighboring holes 21 may be 250 to 600 μm, such as about 350 μm. In FIG. 2*a* and FIG. 2*b*, the holes are hexagonally distributed. The holes may be distributed in other ways as well. Further, the hole density may vary along the extension of the spinneret die 22. The diameter "d" of the holes 21 may be about 55 μm. The surface of spinneret dies 22, wherein the holes 21 are arranged, may be rectangular with a width W and a length L. The length:width ratio may be 5:1 to 100:1. The center-to-center distance D1 between neighboring spinneret dies 22 arranged in parallel may be 8 to 20 mm. The thickness T of the plates may be 5 to 15 mm. The distance D2 between adjacently arranged plates 24 may be 3 to 8 mm. Accordingly, also the width of the flow spacing(s) 23 may be 3 to 8 mm.

FIG. 2*b* shows a top view of an embodiment wherein five parallel, rectangular spinneret dies 22 extend from a first endplate 32*a* to a second endplate 32*b*. The spinneret dies 22 are arranged at plates 24 which are arranged spaced apart with flow spacing 23 in between them in which the aqueous alkaline coagulation bath liquid may flow.

Figure 3A:
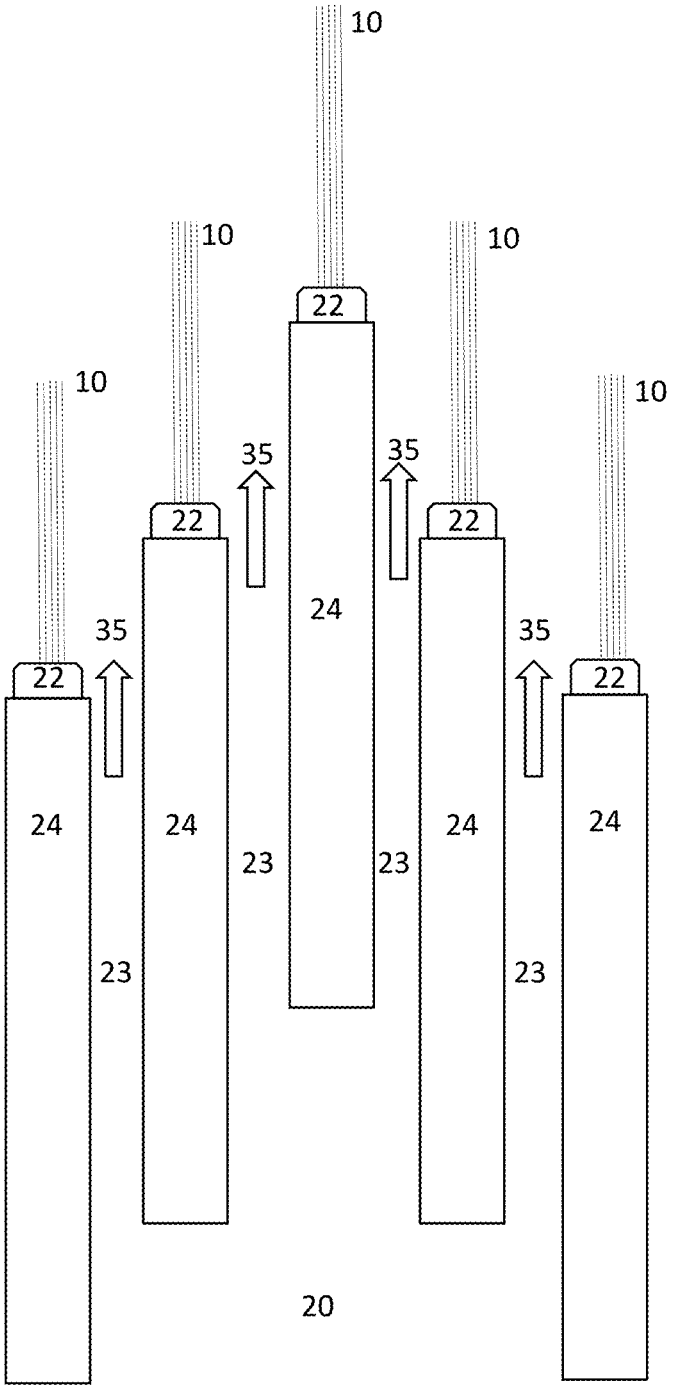

FIG. 3*a* shows a side view of an embodiment wherein five parallel, rectangular spinneret dies 22 are arranged in pyramidal pattern (neighboring spinneret dies 22 are arranged at different vertical levels, i.e. downstream or upstream each other) in the spinning head 20. The spinneret dies 22 are arranged at plates 24. The plates 24 are arranged spaced apart with flow spacing 23 in between them in which the aqueous alkaline coagulation bath liquid flows 35.

Figure 3B:
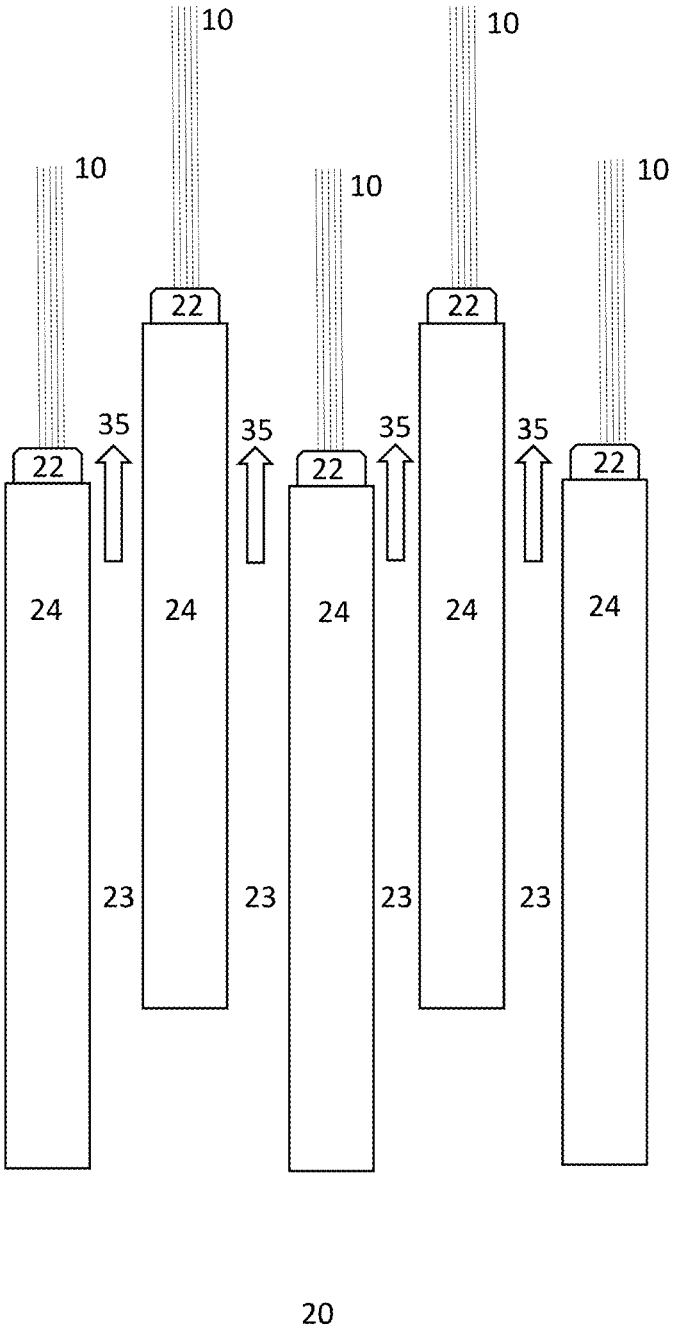

FIG. 3*b* shows a side view of an embodiment wherein five parallel, rectangular spinneret dies 22 are arranged in zigzag pattern (neighboring spinneret dies 22 are arranged at different vertical levels, i.e. downstream or upstream each other) in the spinning head 20. The spinneret dies 22 are arranged at plates 24. The plates 24 are arranged spaced apart with flow spacing 23 in between them in which the aqueous alkaline coagulation bath liquid flows 35.

Figure 3C:
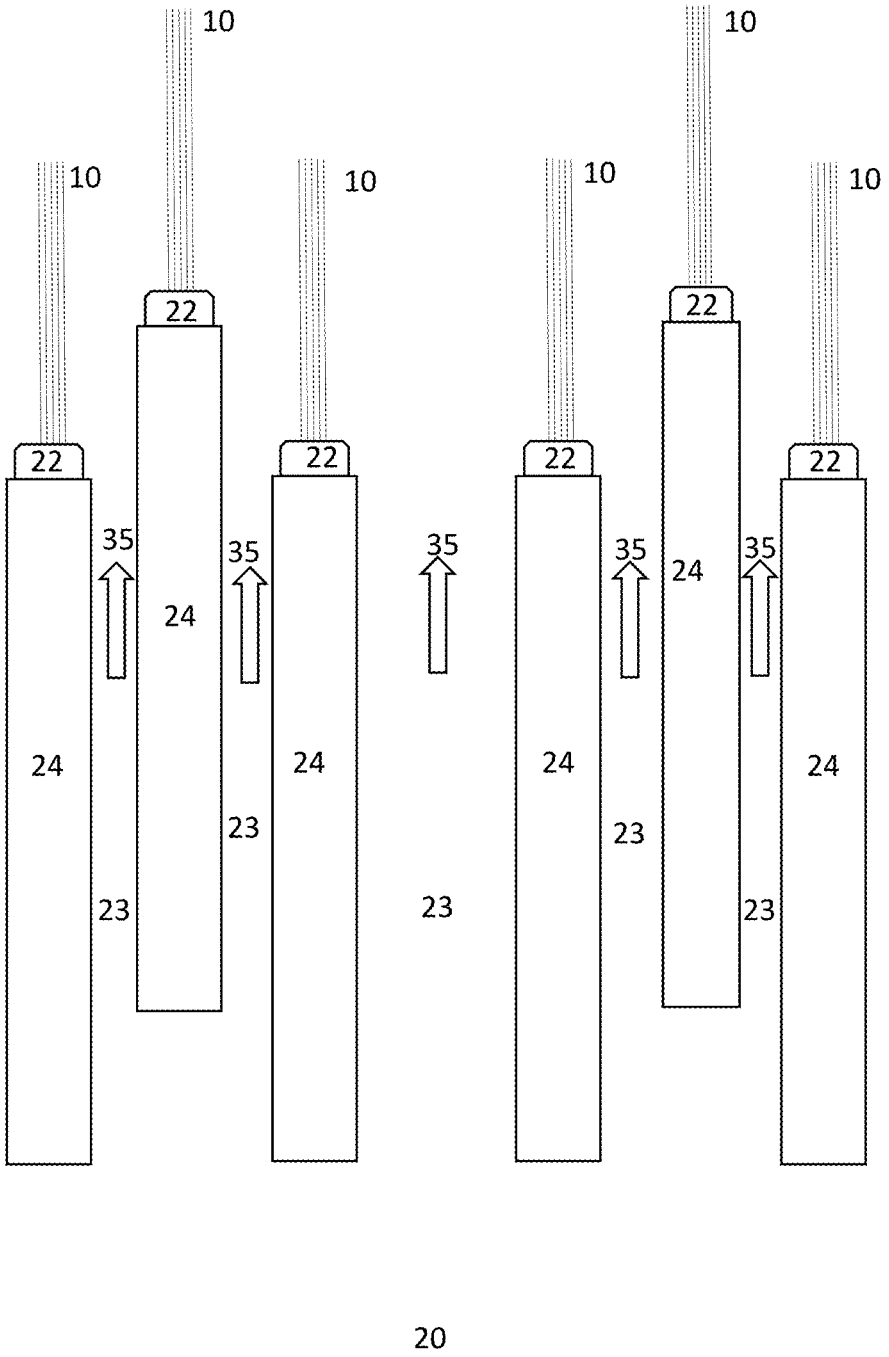

FIG. 3*c* shows a side view of an embodiment wherein six parallel, rectangular spinneret dies 22 are arranged in two groups (the center-to-center distance between neighboring spinneret dies 22 in a group is less than the distance between spinneret dies 22 in different groups) in the spinning head 20. Within each group, the spinneret dies 22 are arranged in pyramidal pattern. The spinneret dies 22 are arranged at plates 24. The plates 24 are arranged spaced apart with flow spacing 23 in between them in which the aqueous alkaline coagulation bath liquid flows 35.

Figure 3D:
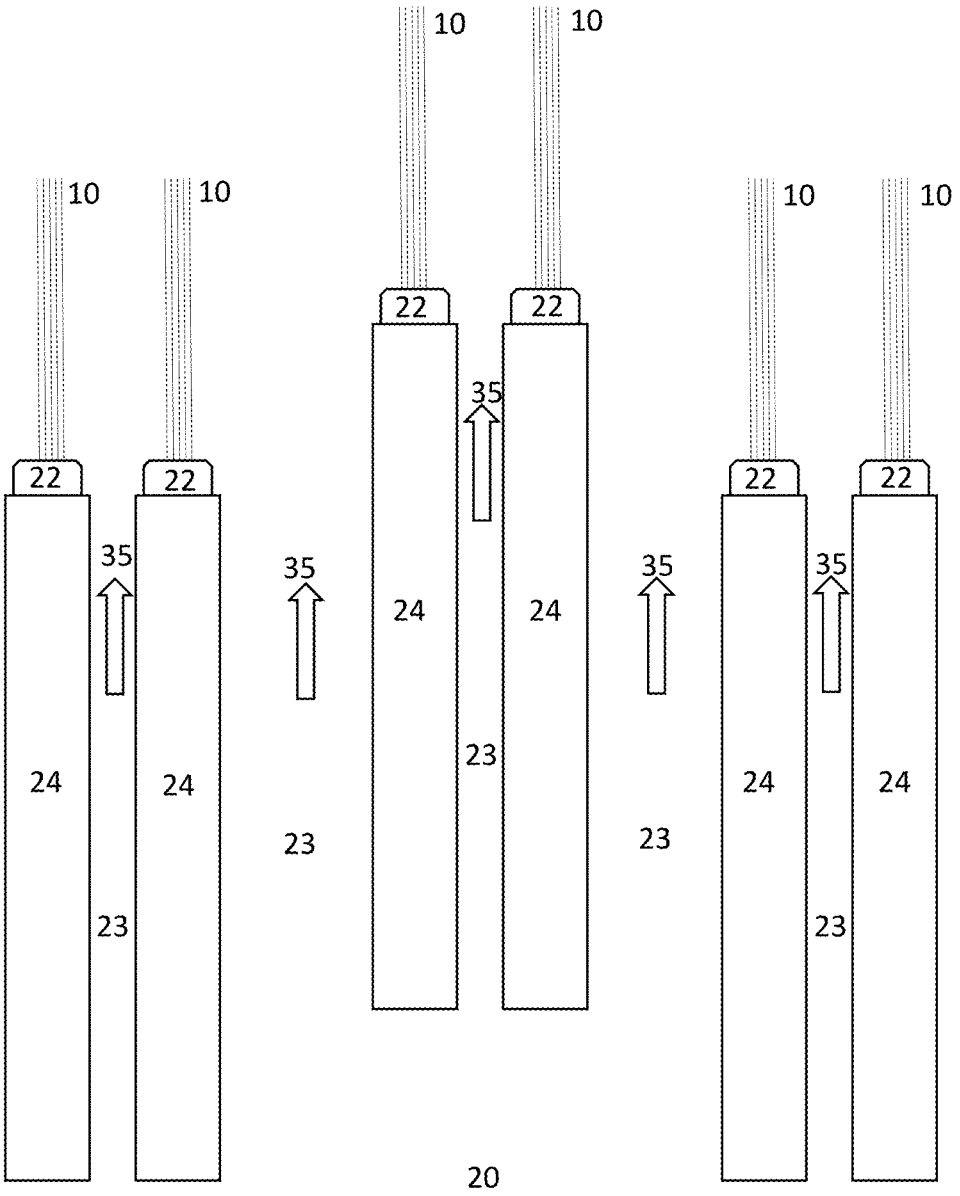

FIG. 3*d* shows a side view of an embodiment wherein six parallel, rectangular spinneret dies 22 are arranged in three groups (the center-to-center distance between adjacent spinneret dies in a group is less than the distance between spinneret dies in different groups) in the spinning head 20. Neighboring groups are arranged at different vertical levels, i.e. downstream or upstream each other. The spinneret dies 22 are arranged at plates 24. The plates 24 are arranged spaced apart with flow spacing 23 in between them in which the aqueous alkaline coagulation bath liquid flows 35.

Figure 3E:
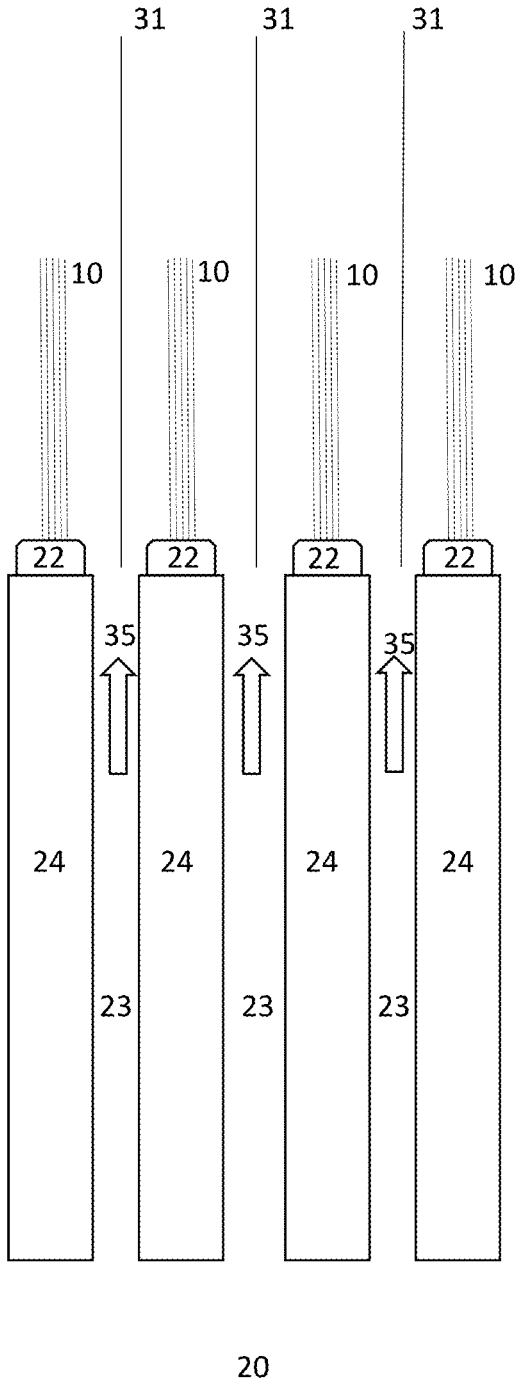

FIG. 3*e* shows a side view of an embodiment wherein screens 31 are arranged in between in between each of four parallel, rectangular spinneret dies 22 in a spinning head 20. The screens 31 extend downstream of the rectangular spinneret dies 22. The spinneret dies 22 are arranged at plates 24. The plates 24 are arranged spaced apart with flow spacing 23 in between them in which the aqueous alkaline coagulation bath liquid flows 35.

Figure 3F:
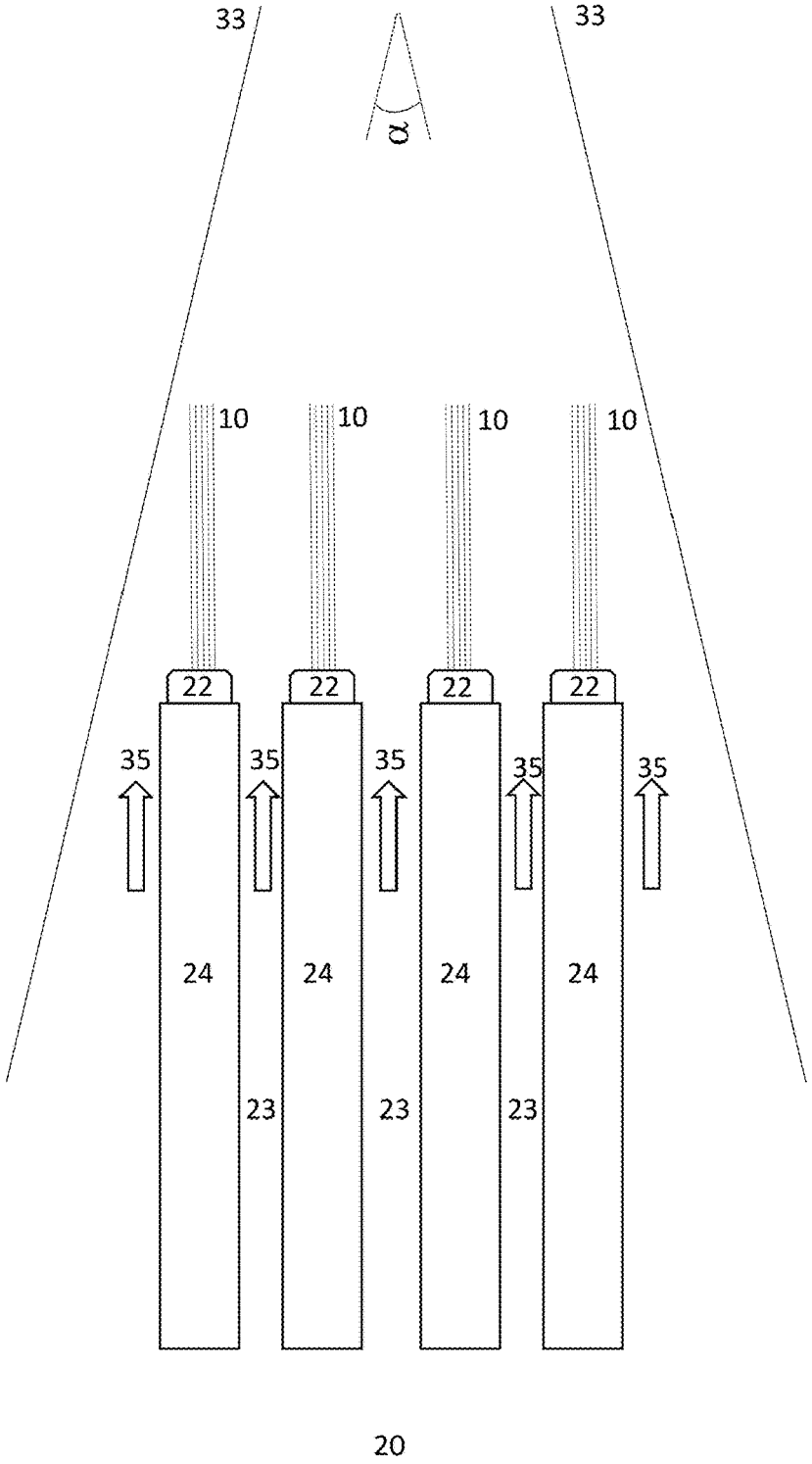

FIG. 3*f* shows a side view of an embodiment wherein a spinning head 20 with four parallel, rectangular spinneret dies 22 is arranged in between two planar deflector plates 33. The deflector plates 33 are arranged in parallel with the longitudinal extension of the spinneret dies 22 and they extend downstream of the rectangular spinneret dies 22. The distance between the deflector plates 33 decreases downstream the spinneret dies 22. The angle (a) between planar deflector plates 33 being tiltedly arranged such that distance between them decreases downstream the spinneret dies 22 may be 15 to 75°. The distance D3 between the deflector plates 33 at an end downstream and distal to the spinneret dies 22 may be at least 5 mm. Further, the deflector plates 33 may be bent or curved.

Figure 3G:
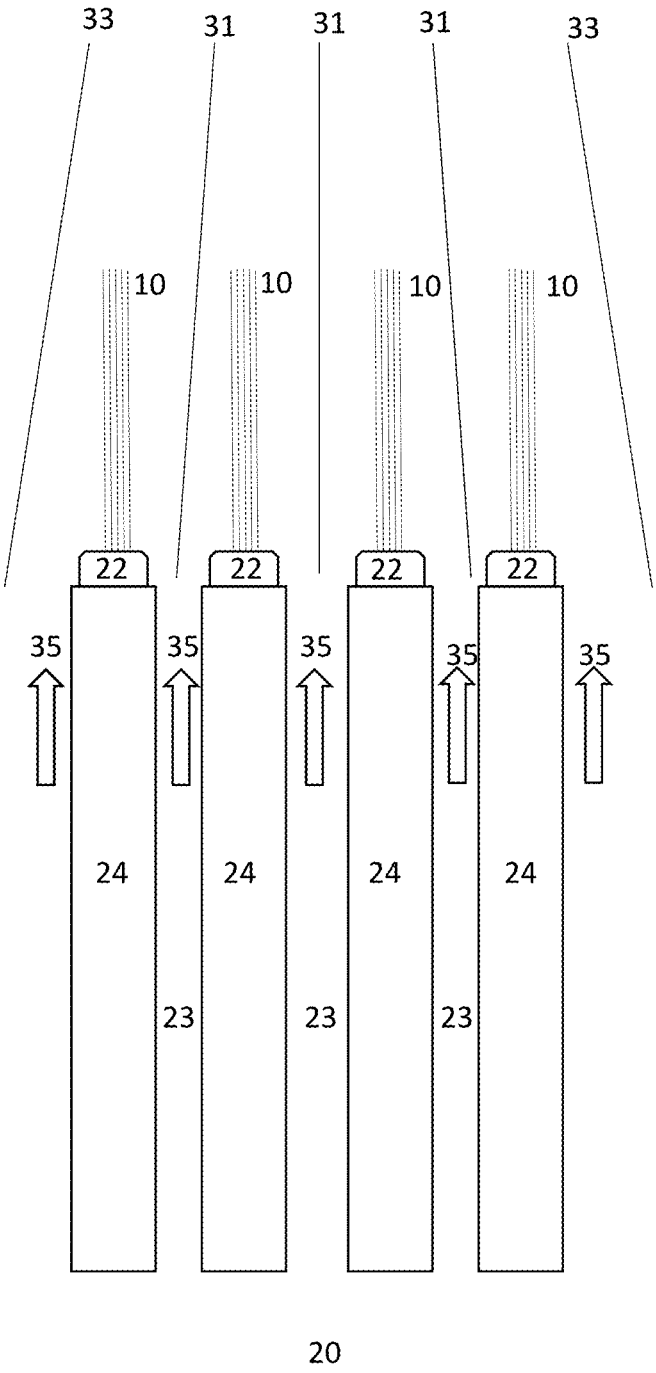

FIG. 3*g* shows a side view of an embodiment wherein a spinning head 20 with four parallel, rectangular spinneret dies 22 is provided with both screens 31 and deflector plates 33.

Figure 3H:
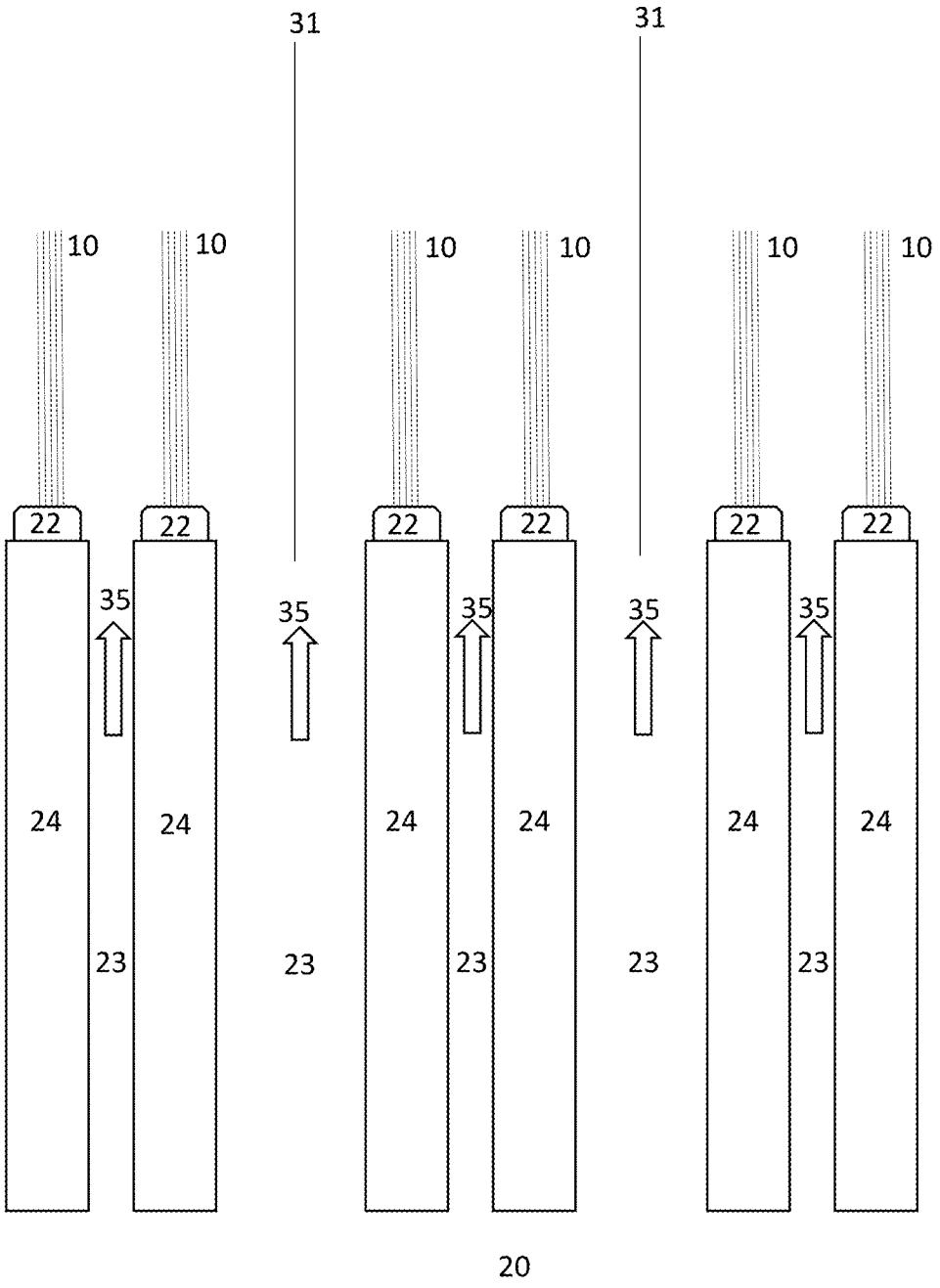

FIG. 3*h* shows a side view of an embodiment wherein a spinning head 20 with six parallel, rectangular spinneret dies 22 arranged pairwise in three groups with screens 31 in between the groups.

Figure 3I:
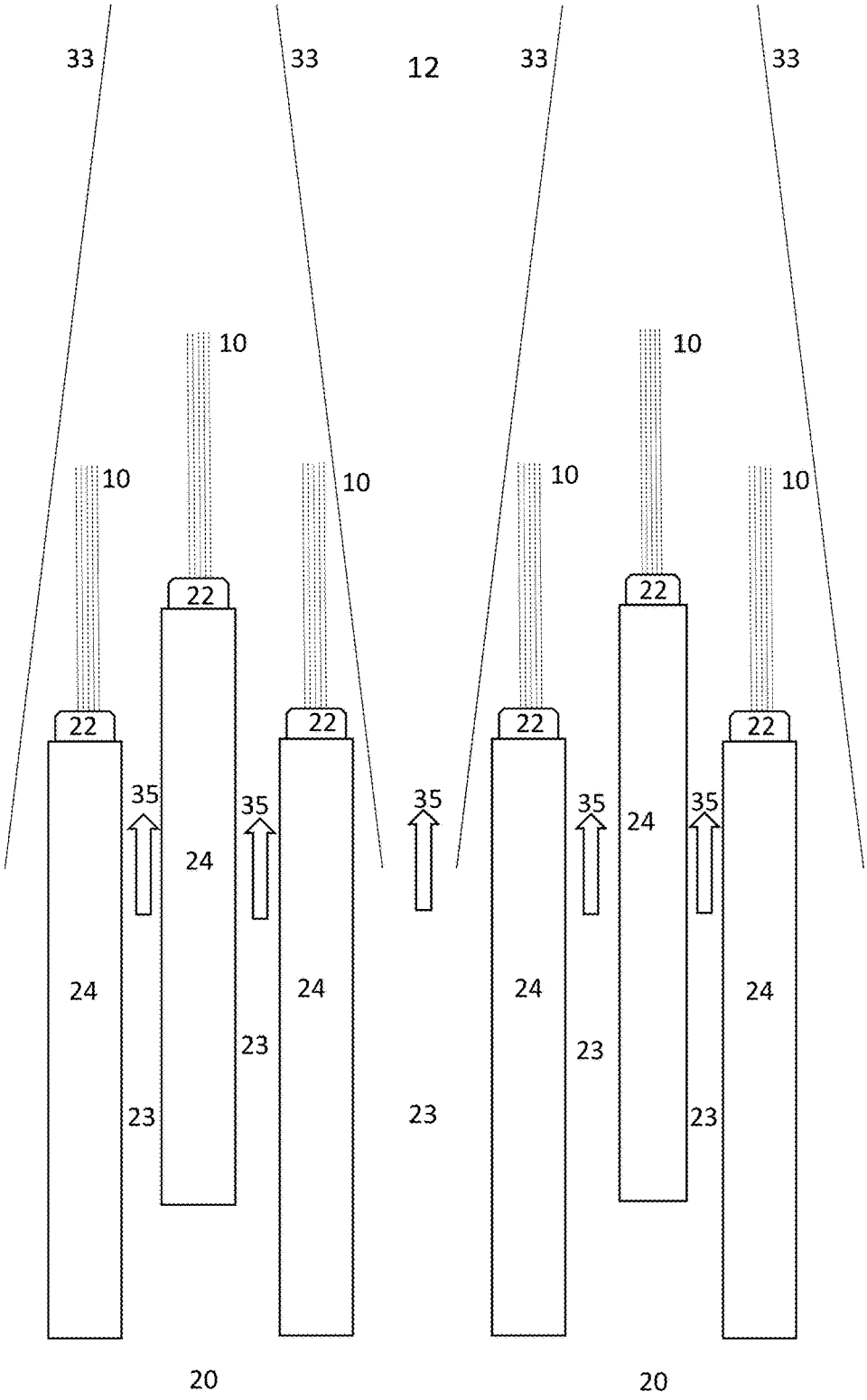

FIG. 3*i* shows a side view of an embodiment wherein two spinning heads 20, each being arranged in between two deflector plates 33, are arranged to provide an arrangement of spinning heads. The distance D3 between the deflector plates 33 in each pair of deflector plates 33 at an end downstream and distal to the spinneret dies 22 may be at least 5 mm. The rectangular spinneret dies 22 are arranged in pyramidal pattern in each spinning head 20.

As can be seen in FIG. 4, plates 24 (8 mm thick) of a spinning head 20, may be provided with flow channels 25 for receiving the alkaline cellulose spin dope, distributing it, and feeding it to the dies 22 with the holes 21. Further, as can be seen, the spinneret dies 22 (width 4 mm) may be arranged in slits in the plates 24. The thickness of the plate may be tapered adjacent to the edge at which the spinneret die 22 is arranged.

EXAMPLES

Example 1

A number spinning heads, of which some are shown in FIGS. 5 to 7, were evaluated by spinning a spin dope into an aqueous alkaline coagulation bath liquid. The maximum spinning rate for each spinning head was determined. The maximum spinning rate was defined as the highest possible spinning rate without any filament breakage and lump formation in the coagulation bath. The draft ratio was 1.0.

Spin Dope

A spin dope comprising 6.0 wt-% acid hydrolyzed birch pulp (intrinsic viscosity=210), 7.5 wt-% NaOH and 0.95 wt-% ZnO was used. In preparing the spin dope, it was filtered in a filter press through two polypropylene non-woven filter media in series (coarse and fine).

Aqueous Alkaline Coagulation Bath Liquid

An aqueous alkaline coagulation bath liquid comprising 21 wt-% $Na_2CO_3$ and 5.7 wt-% NaOH was used. The spin bath depth was 80 cm and the temperature in the coagulation bath was 29° C.

Spinneret Die

The dimensions of the rectangular spinneret dies used were 4×50 mm. Each spinneret die comprised 1197 holes (hexagonally arranged in 9 rows; the distance between the hole centers of holes in the outermost rows was 2.42 mm) with a diameter of 60 μm. The distance between the hole centers of adjacent holes was 350 μm.

Results

A spinning head with five pyramidally arranged spinning dies and two deflector plates (cf. FIG. 5) had maximum spinning rate of 25 m/min. Without the deflector plates, the maximum spinning rate was reduced to 15 m/min.

A spinning head with five spinning dies arranged on the same vertical level, screens arranged in between in the spinning dies, and two deflector plates (cf. FIG. 6) had maximum spinning rate of 20 m/min.

A spinning head with four spinning dies arranged on the same vertical level and two deflector plates (cf. FIG. 7) had maximum spinning rate of more than 10 m/min. Without the deflector plates, the maximum spinning rate was reduced to well below 10 m/min.

In summary, it could be concluded that flow directing means improved the maximum spinning rate. Further, it was found to be advantageous to combine various types of flow directing means.

Example 2-Spinneret Die with Nine Lines of Holes Arranged in a Rectangular Group Compared to a Conventional Spinneret Die As a model system, a rectangular group of holes with in total nine lines of holes was compared to a conventional circular arrangement of holes in a circular group. Both groups, i.e. the rectangular group and the circular group, respectively, were arranged in a circular surface. The rectangular group comprised 541 holes (Ø 60 μm) arranged in nine parallel lines in a hexagonal pattern. The distance between the perimeters of two adjacent holes in a line was 140 μm (200 μm between hole centers). The circular group had 400 holes (Ø 60 μm) arranged concentrically in circles such that the distance between perimeters of two adjacent holes was about 540 μm (about 600 μm between hole centers).

The spin dope comprised 6.0 wt-% cellulose (IV=210 ml/g) dissolved in cold alkali. The aqueous alkaline coagulation bath liquid used comprised 20 wt-% $Na_2CO_3$ and 5.6 wt-% NaOH. Its temperature was 28° C. The spin bath depth was 400 mm.

Spinning was started at a low extrusion speed (exit speed) and was gradually increased to find the maximum possible exit speed producing stable spinning without lump formation. The draft ratio (take up speed/exit speed) was kept constant at 1.0 during the experiment.

The rectangular spinneret die allowed for significantly higher exit speeds (26 to 30 m/min compared to 10 m/min for the conventional circular spinneret die), even though the holes were more densely (distance between perimeters of two adjacent holes 140 μm vs. 540 μm) arranged.

It could thus be concluded that rectangular spinneret dies are more efficient than conventional circular spinneret dies even if not provided with flow directing means.

The invention claimed is:

1. A process for spinning an alkaline cellulose spin dope, comprising dissolved cellulose, to cellulose filaments, the process comprising the steps of:

feeding the alkaline cellulose spin dope to at least one spinning head (20) with a plurality of holes, wherein the spinning head comprises at least two parallel, rectangular spinneret dies, each with a plurality of holes, the spinneret dies being arranged spaced apart with a flow spacing in between them;

extruding the alkaline cellulose spin dope through the plurality of holes into a flow of aqueous alkaline coagulation bath liquid, the aqueous alkaline coagulation bath liquid comprising a sodium coagulation salt, whereby forming cellulose filaments, wherein the aqueous alkaline coagulation bath liquid flows through the flow spacing and then past the spinneret dies in a flow direction, the flow direction of the aqueous alkaline coagulation bath liquid being parallel to the direction in which the alkaline cellulose spin dope is extruded into the aqueous alkaline coagulation bath liquid; and withdrawing the cellulose filaments from the aqueous alkaline coagulation bath liquid.

2. A process for spinning an alkaline cellulose spin dope, comprising dissolved cellulose, to cellulose filaments, the process comprising the steps of:

feeding the alkaline cellulose spin dope to at least one spinning head (20) with a plurality of holes, wherein the spinning head comprises at least two parallel, rectangular spinneret dies, each with a plurality of holes, the spinneret dies being arranged spaced apart with a flow spacing in between them;

extruding the alkaline cellulose spin dope through the plurality of holes into a flow of aqueous alkaline coagulation bath liquid, the aqueous alkaline coagulation bath liquid comprising a sodium coagulation salt, whereby forming cellulose filaments, wherein the aqueous alkaline coagulation bath liquid flows through the flow spacing and then past the spinneret dies in a flow direction, the flow direction of the aqueous alkaline coagulation bath liquid being parallel to the direction in which the alkaline cellulose spin dope is extruded into the aqueous alkaline coagulation bath liquid; and withdrawing the cellulose filaments from the aqueous alkaline coagulation bath liquid; wherein the spinning head comprises at least three, preferably three to seven, rectangular spinneret dies, preferably having flow spacings between each of them; and/or wherein the rectangular spinneret dies have a length:width ratio of at least 5:1, such as a length: width ratio of 5:1 to 200:1, or a length: width ratio of 10:1 to 100:1; preferably the rectangular spinneret dies each has a continuous rectangular surface with a plurality of holes.

3. The process according to claim 1, wherein a system comprising the spinning head is arranged to:

reduce flow of aqueous alkaline coagulation bath liquid across the rectangular spinneret dies; and/or guide the flow of aqueous alkaline coagulation bath liquid, in passing the rectangular spinneret dies, to be parallel to the direction in which the alkaline cellulose spin dope is extruded; and/or keep cellulose filaments from a first rectangular spinneret die apart from filaments from a second rectangular spinneret die; and/or promote and direct self-convection of aqueous alkaline coagulation bath liquid.

4. The process according to claim 1, wherein a first rectangular spinneret die is arranged downstream, or upstream, of a neighboring second rectangular spinneret die, and/or wherein the first and a third rectangular spinneret die are arranged upstream of the second rectangular spinneret die; preferably the second rectangular spinneret die being arranged in between the first and the third spinneret die;

and/or wherein the first and a third rectangular spinneret die are arranged upstream of the second rectangular spinneret die and a fourth rectangular spinneret die; preferably the second rectangular spinneret die being arranged in between the first and the third rectangular spinneret die, and the fourth spinneret die being arranged next to the third spinneret die on a side opposite to the second rectangular spinneret die;

and/or wherein at least four spinneret dies are arranged in a zig-zag pattern.

5. The process according to claim 1, wherein a screen is arranged in between two neighboring rectangular spinneret dies, the screen extending at least downstream of the rectangular spinneret dies, whereby keeping cellulose filaments from a first rectangular spinneret die apart from filaments from a second rectangular spinneret die.

6. The process according to claim 1, wherein the parallel, rectangular spinneret dies extend from a first endplate to a second endplate, the endplates extending downstream of the spinneret dies in the flow direction, whereby flow of aqueous alkaline coagulation bath liquid from the short ends of the spinneret dies along their longitudinal extension is hindered, and/or wherein the spinning head is arranged in between two deflector plates being arranged in parallel with the longitudinal extension of the spinneret dies and extending downstream of the rectangular spinneret dies; preferably the distance between the deflector plates decreasing downstream the spinneret dies.

7. The process according to claim 6, wherein the deflector plates together with the endplates form an extrusion channel.

8. The process according to claim 1, wherein the aqueous alkaline coagulation bath liquid flows, at least partly, by self-convection resulting from the extrusion of the alkaline cellulose spin dope into the aqueous alkaline coagulation bath liquid and from the withdrawal of the cellulose filaments from the aqueous alkaline coagulation bath liquid, preferably the coagulation bath liquid flows solely by self-convection.

9. The process according to claim 1, wherein:

the aqueous alkaline coagulation bath liquid upon extruding the alkaline cellulose spin dope into it comprises 10 to 30 wt. % sodium coagulation salt, e.g. sodium carbonate ($Na_2CO_3$) and/or sodium sulfate ($Na_2SO_4$), such as 15 to 25 wt. % sodium coagulation salt, e.g. sodium carbonate ($Na_2CO_3$) and/or sodium sulfate ($Na_2SO_4$); and/or the temperature of the alkaline cellulose spin dope upon extruding it into the aqueous alkaline coagulation bath liquid is 5° C. to 30° C., preferably 10° C. to 25° C.; and/or the temperature of the aqueous alkaline coagulation bath liquid, upon extruding the alkaline cellulose spin dope into it, is 20° C. to 50° C., preferably 25° C. to 40° C.; and/or the alkaline cellulose spin dope comprises 4 to 12 wt. %, preferably 5 to 8 wt. % cellulose; and/or the cellulose in the alkaline cellulose spin dope has a DP of 140 to 600, such as 180 to 600, 200 to 400, 160 to 400, or 180 to 300; and/or the cellulose in the alkaline cellulose spin dope has an intrinsic viscosity according to ISO5351: 2010 (E) of 115 to 450 ml/g, such as 150 to 450 ml/g, 190 to 300 ml/g, 130 to 300 ml/g, or 140 to 230 ml/g; and/or the alkaline cellulose spin dope has a viscosity measured at 20° C. and at a shear rate of 0.2 $s^{-1}$ of 1 to 200 Pas, preferably 1 to 50 Pas; and/or the cellulose in the alkaline cellulose spin dope has a degree of substitution DS of not more than 0.3, preferably not more than 0.1; and/or;

the alkaline cellulose spin dope comprises 5 to 10 wt. % NaOH, preferably 6.5 to 8.5 wt. % NaOH.

10. A system for spinning an alkaline cellulose spin dope, comprising dissolved cellulose, into an aqueous alkaline coagulation bath liquid, comprising a sodium coagulation salt, whereby forming cellulose filaments, the system comprising at least one spinning head with a plurality of holes for extruding the alkaline cellulose spin dope into the aqueous alkaline coagulation bath liquid, wherein the spinning head comprises at least two parallel, rectangular spinneret dies, each with a plurality of holes from which the alkaline cellulose spin dope is to be extruded, the spinneret dies being arranged spaced apart to form flow spacing(s) in between them, whereby the aqueous alkaline coagulation bath liquid may flow in between the spinneret dies and then past the spinneret dies in a direction parallel to the direction in which the alkaline cellulose spin dope is extruded into the aqueous alkaline coagulation bath liquid.

11. The system according to claim 10, wherein the rectangular spinneret dies have a length: width ratio of at least 5:1, such as a length: width ratio of 5:1 to 200:1, or a length: width ratio of 10:1 to 100:1; preferably the width (W) of spinneret dies being 10 mm or less, such as 0.5 to 7 mm, 1 to 6 mm, or 1.5 to 5 mm, and/or preferably the center-to-center distance (ccd) of neighboring spinneret dies arranged in parallel being 8 to 20 mm, and/or wherein each spinneret die is arranged on an edge of plate, the plates being arranged in parallel, wherein each plate is provided with flow channels for receiving the alkaline cellulose spin dope, distributing it, and feeding it to the spinneret dies with the holes, preferably each plate having a length (L) of 5 to 50 cm, and/or preferably the distance between the neighboring plates arranged in parallel being 3 to 10 mm such as 5 to 8 mm, the width of the flow spacing(s) thus being 3 to 10 mm such as 5 to 8 mm.

12. The system according to claim 10, wherein the system is arranged to:

reduce flow of aqueous alkaline coagulation bath liquid across the rectangular spinneret dies; and/or guide the flow of aqueous alkaline coagulation bath liquid, in passing the rectangular spinneret dies, to be parallel to the direction in which the alkaline cellulose spin dope is extruded; and/or keep cellulose filaments from a first rectangular spinneret die apart from filaments from a second rectangular spinneret die; and/or promote and direct self-convection of aqueous alkaline coagulation bath liquid.

13. The system according to claim 10, wherein a first rectangular spinneret die is arranged downstream, or upstream, of a neighboring second rectangular spinneret die, and/or wherein the first and a third rectangular spinneret die are arranged upstream of the second rectangular spinneret die; preferably the second rectangular spinneret die being arranged in between the first and the third spinneret die;

and/or wherein the first and a third rectangular spinneret die are arranged upstream of the second rectangular spinneret die and a fourth rectangular spinneret die; preferably the second rectangular spinneret die being arranged in between the first and the third rectangular spinneret die, and the fourth spinneret die being arranged next to the third spinneret die on a side opposite to the second rectangular spinneret die; wherein at least four spinneret dies are arranged in a zig-zag pattern.

14. The system according to claim 10, wherein a screen is arranged in between two neighboring rectangular spinneret dies, the screen extending at least downstream of the rectangular spinneret dies, whereby keeping cellulose filaments from a first rectangular spinneret die apart from filaments from a second rectangular spinneret die; preferably the screen extending at least 10 mm, such as at least 25 mm, or at least to 50 mm, downstream of the spinneret dies; and/or the screen extending 10 mm to 300 mm, such as 25 to 150, downstream of the spinneret dies.

15. The system according to claim 10, wherein the parallel, rectangular spinneret dies extend from a first endplate to a second endplate, the endplates extending downstream of the spinneret dies in the flow direction, whereby flow of aqueous alkaline coagulation bath liquid from the short ends of the spinneret dies along their longitudinal extension is hindered.

16. The system according to claim 10, wherein the spinning head is arranged in between two deflector plates being arranged in parallel with the longitudinal extension of the spinneret dies and extending downstream of the rectangular spinneret dies; preferably the distance between the deflector plates decreasing downstream the spinneret dies.

17. The system according to claim 15, wherein the deflector plates together with the endplates forms an extrusion channel.

18. The system according to claim 10, wherein:

the holes have a diameter of 40 to 100 μm; and/or the center-to-center distance (ccd) of neighboring holes is 250 to 600 μm.

19. The system according to claim 10, wherein the spinning head is present within a vessel for aqueous alkaline coagulation bath liquid, optionally the vessel comprises a plurality of spinning heads arranged adjacent to each other.

20. The system according to claim 10, wherein the system further comprises withdrawal means for withdrawing the cellulose filaments from the aqueous alkaline coagulation bath liquid; preferably the system further comprising a press for pressing aqueous alkaline coagulation bath liquid from the cellulose filaments.

* * * * *